US006991508B2

(12) United States Patent
McClung et al.

(10) Patent No.: US 6,991,508 B2
(45) Date of Patent: Jan. 31, 2006

(54) BOX GAMES AND ACTIVITIES

(76) Inventors: John Michael McClung, PMB 347, 16690 Champion Forest Dr., Spring, TX (US) 77379; Karen Therese McClung, PMB 347, 16690 Champion Forest Dr., Spring, TX (US) 77379; Guy L. McClung, III, PMB 347, 16690 Champion Forest Dr., Spring, TX (US) 77379; Elizabeth M. McClung, PMB 347, 16690 Champion Forest Dr., Spring, TX (US) 77379; Guy L. McClung, IV, 4949 Hwy 105 #204, Montgomery, TX (US) 77356; Sarah T. McClung, 8002 Hertfordshire Cir., Spring, TX (US) 77379

( * ) Notice: Subject to any disclaimer, the term of this patent is extended or adjusted under 35 U.S.C. 154(b) by 0 days.

(21) Appl. No.: 10/784,543

(22) Filed: Feb. 23, 2004

(65) Prior Publication Data

US 2005/0075032 A1 Apr. 7, 2005

Related U.S. Application Data

(60) Division of application No. 09/953,094, filed on Sep. 14, 2001, now Pat. No. 6,755,711, and a continuation-in-part of application No. 09/871,170, filed on May 31, 2001, now Pat. No. 6,585,551.

(51) Int. Cl.
*A63H 27/00* (2006.01)

(52) U.S. Cl. ..... 446/46; 446/48; 446/588

(58) Field of Classification Search ..... 446/46, 446/48, 49, 61, 385, 487; 473/588, 589; 273/398, 401, 402, 404, 407–408; 206/216, 206/551

See application file for complete search history.

(56) References Cited

U.S. PATENT DOCUMENTS

| | | | | |
|---|---|---|---|---|
| 669,617 | A | 3/1901 | Butterly | |
| 1,029,069 | A | 6/1912 | Lazaron | |
| 1,518,981 | A | 12/1924 | Hammond-Knowlton | |
| 2,032,531 | A | 3/1936 | Eaton | |
| 2,083,000 | A | 6/1937 | Bennard | |
| 2,134,971 | A | 11/1938 | Guyer | 229/8 |
| 2,197,451 | A | 4/1940 | Eaton | |
| 2,636,312 | A | 4/1953 | Martin | |
| 2,744,355 | A | 5/1956 | DelMar | |
| 3,100,642 | A | 8/1963 | Goldstein | 206/459.5 |
| 3,155,392 | A | 11/1964 | Ruderian | 446/79 |
| 3,233,356 | A | 2/1966 | Thompson | |
| D209,526 | S | 12/1967 | Dunbar | D34/15 |
| 3,359,678 | A | 12/1967 | Headrick | |
| 3,971,156 | A | 7/1976 | Lamlee | 46/1 L |
| 4,087,576 | A | 5/1978 | Patterson | 428/8 |
| 4,112,612 | A | 9/1978 | Woods | 46/74 D |
| D253,659 | S | 12/1979 | Weeks | D19/26 |
| 4,207,702 | A | 6/1980 | Boatman et al. | 46/74 D |
| 4,648,548 | A | 3/1987 | Shin | 229/8 |
| 4,891,482 | A | 1/1990 | Jaeger et al. | 219/10.55 |
| 4,919,083 | A | 4/1990 | Axelrod | 119/29 |

(Continued)

*Primary Examiner*—Kien Nguyen
(74) *Attorney, Agent, or Firm*—Guy McClung

(57) ABSTRACT

A play activity set having, in at least certain aspects, target apparatus at which at least one object may be directed; at least one object for throwing at the target apparatus; the target apparatus and the at least one object made by separating box material from a single box or from a plurality of boxes; and, in one aspect, such a play activity set wherein the single box is, e.g., a pizza box.

21 Claims, 15 Drawing Sheets

U.S. PATENT DOCUMENTS

| | | | | |
|---|---|---|---|---|
| 4,919,326 | A | 4/1990 | Deiger | 229/109 |
| 5,020,808 | A | 6/1991 | Richards | 273/425 |
| 5,173,070 | A | 12/1992 | Gould | 446/79 |
| 5,222,657 | A | 6/1993 | Holland, Jr. | 229/103 |
| 5,246,161 | A | 9/1993 | Kapp | 229/103 |
| 5,358,440 | A | 10/1994 | Zheng | 446/48 |
| 5,480,334 | A | 1/1996 | Wilson et al. | 446/46 |
| 5,531,624 | A | 7/1996 | Dunipace | 446/46 |
| 5,540,610 | A | 7/1996 | Sneddon | 446/46 |
| 5,553,327 | A | 9/1996 | Koecher et al. | 2/200.3 |
| 5,586,716 | A | 12/1996 | Correll | 229/110 |
| 5,595,339 | A | 1/1997 | Correll | 229/109 |
| 5,655,944 | A | 8/1997 | Fusselman | 446/67 |
| 5,657,562 | A | 8/1997 | Desormeaux | 40/124.01 |
| D388,134 | S | 12/1997 | Dunipace | D21/86 |
| 5,702,054 | A | 12/1997 | Philips et al. | 229/110 |
| 5,713,509 | A | 2/1998 | Correll | 229/109 |
| 5,833,130 | A | 11/1998 | Correll | 229/108 |
| 6,016,951 | A | 1/2000 | Correll | 229/101 |
| D420,583 | S | 2/2000 | Cooper, Jr. | D9/422 |
| 6,022,260 | A | 2/2000 | Fritzel | 446/93 |
| 6,065,669 | A | 5/2000 | Correll | 229/112 |
| 6,068,114 | A | 5/2000 | Zimmerman et al. | 206/216 |
| 6,120,344 | A | 9/2000 | Brown | 446/388 |
| 6,136,400 | A | 10/2000 | Katayose et al. | 428/42.1 |
| 6,206,277 | B1 | 3/2001 | Correll | 229/101 |
| 6,585,551 | B2 * | 7/2003 | McClung et al. | 446/46 |
| 6,755,711 | B2 * | 6/2004 | McClung et al. | 446/46 |

* cited by examiner

FIG.1A
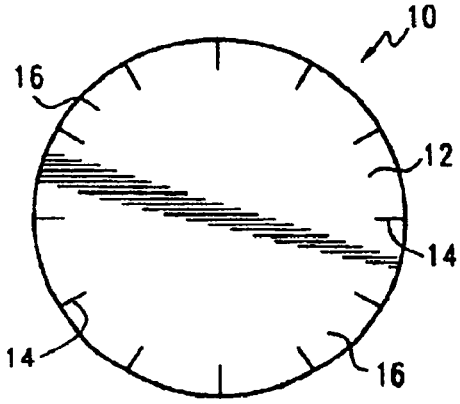
FIG.1B
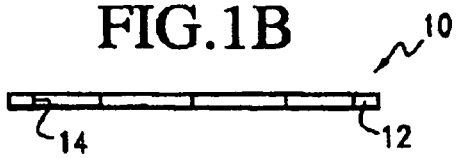
FIG.1C
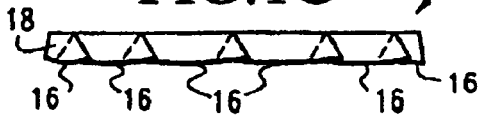
FIG.2A
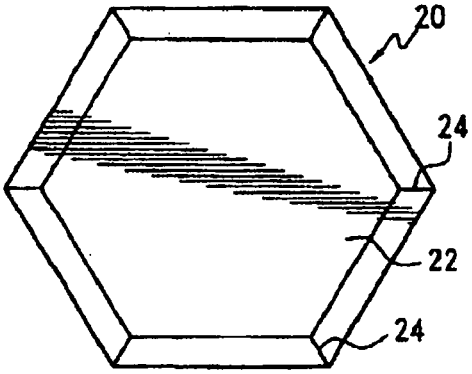
FIG.2B
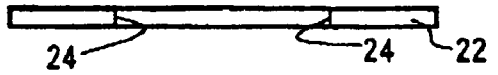
FIG.2C
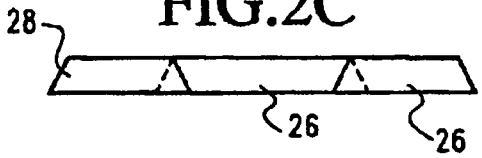
FIG.3A
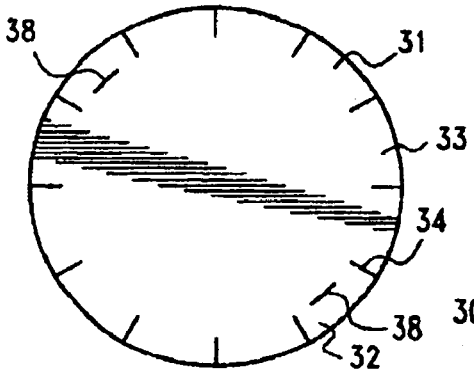
FIG.3B
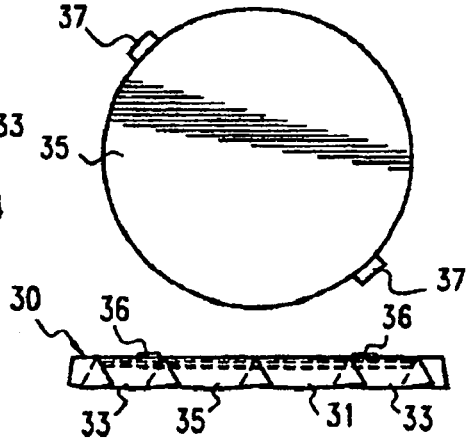
FIG.3C

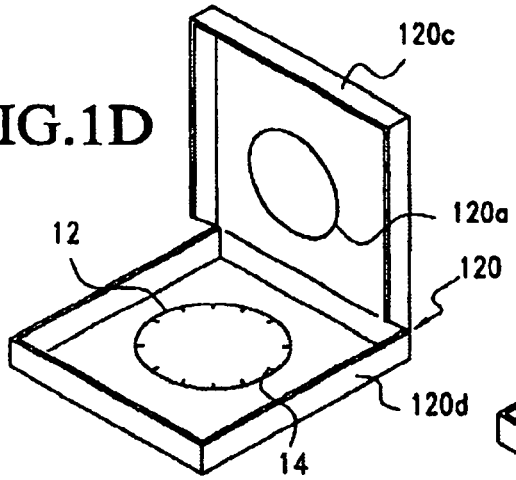
FIG.1D
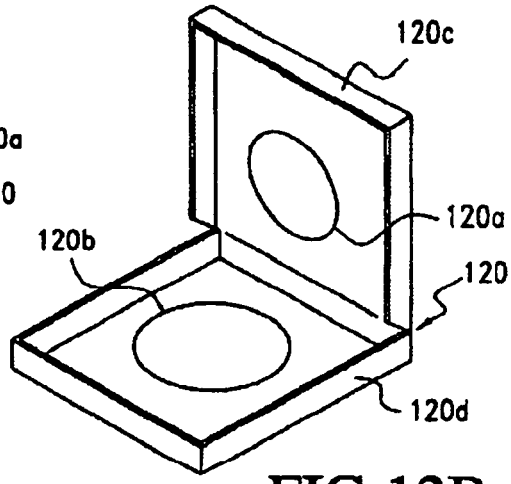
FIG.12B
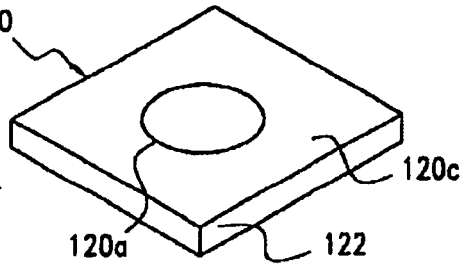
FIG.12A
FIG.12C
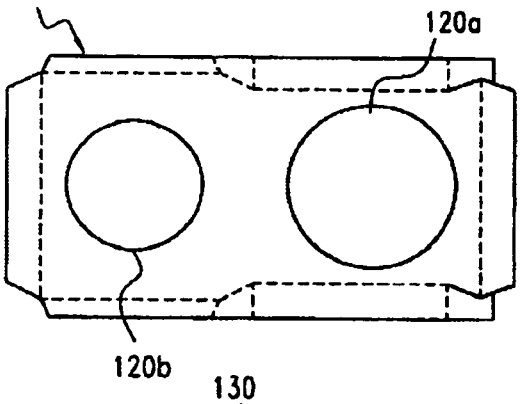
FIG.12D
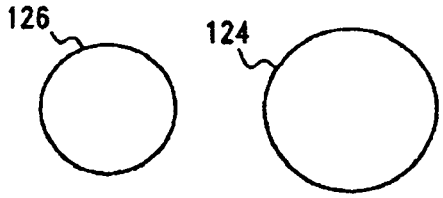
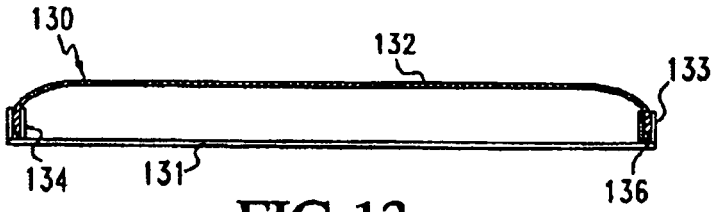
FIG.13

FIG.4A
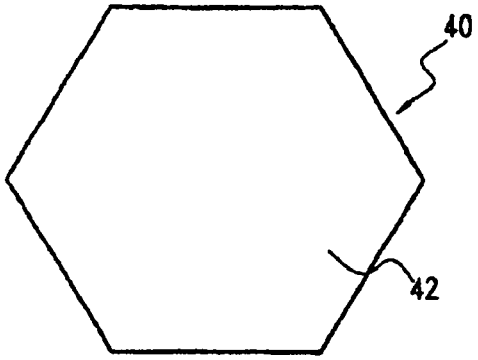
FIG.4B
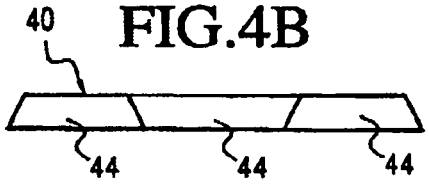
FIG.5
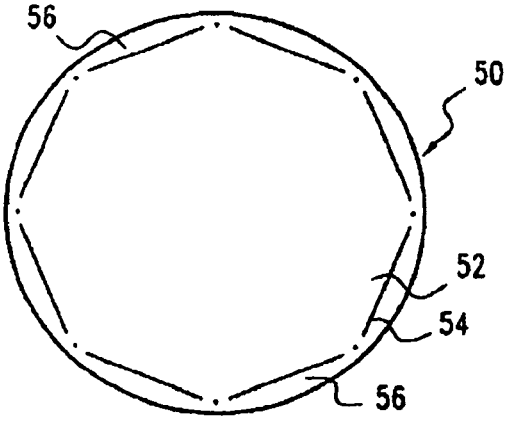
FIG.6
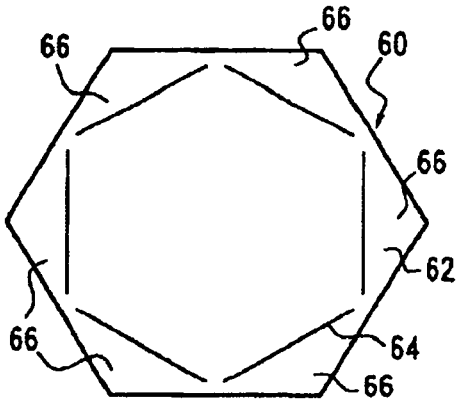
FIG.7A
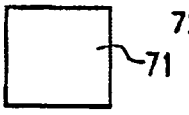
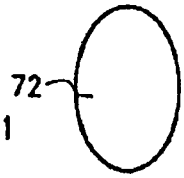
FIG.7B
FIG.7C
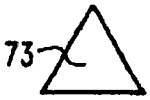
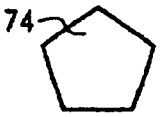
FIG.7D
FIG.7E
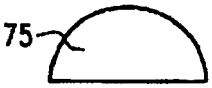
FIG.8
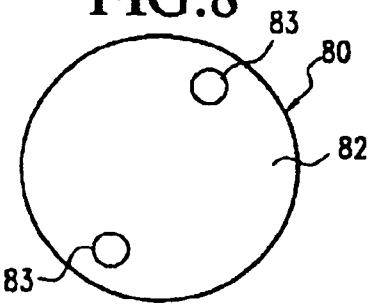
FIG.9A
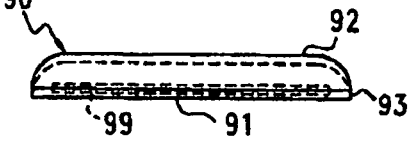
FIG.9B
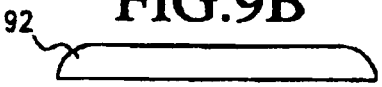

BOX GAMES AND ACTIVITIES

RELATED APPLICATION

This is a division of U.S. application Ser. No. 09/953,094 filed 14 Sep. 2001 now U.S. Pat. No. 6,755,711 and a continuation-in-part of U.S. application Ser. No. 09/871,170 filed May 31, 2001 now U.S. Pat. No. 6,585,551 both said applications incorporated fully herein for all purposes

BACKGROUND OF THE INVENTION

1. Field of the Invention

This invention is directed to games and play activities with respect to which game pieces and activity items are made from a box, in certain specific aspects from a single box such as, but not limited to a cereal box or a pizza box; and in certain aspects to flying discs, and to items with them.

2. Description of Related Art

The prior art discloses a wide variety of games and play activities that employ game pieces, game equipment, activity items, and other things used in playing the game or in engaging in the activity. Often such games and activities involve the use of a target and items thrown to, into, or at the target.

The prior art discloses a wide variety of boxes, e.g. those disclosed in U.S. Pat. Nos. 5,702,054; 5,586,716; 6,016,951; 5,833,130; 4,891,482; 5,713,509; and in the prior art cited in these patents—all of which patents and cited art are incorporated fully herein for all purposes.

The prior art discloses a wide variety of flying discs, flying objects, and toys, e.g. those disclosed in U.S. Pat. Nos. 5,553,570; 5,531,624; and 6,073,588 and in the prior art cited in these patents—all of which patents and cited art are incorporated fully herein for all purposes.

SUMMARY OF THE PRESENT INVENTION

The present invention discloses, in at least certain embodiments, a play activity set with target apparatus or devices(s) at which at least one object may be directed, at least one object for throwing at the target means, and the target apparatus or device(s) and the at least one object made by separating box material from at least one box. In one aspect, a single box is used for target(s) and throwing object(s); and, in one particular aspec, the box (or boxes) is a pizza box.

The present invention, in certain aspects, discloses boxes for games and activities. The boxes are used as the source material for game pieces, game equipment, activity items, targets, and things used in such games and activities. In certain aspects everything needed for a game or for an activity is made from a box or boxes. In certain aspects, everything needed for such a game or activity is made from a single box. In certain specific aspects the box (or boxes) is a pizza box or a breakfast cereal box.

In one embodiment a first part of a box is separated or removed from the box (severed, cut, punched out, and/or pushed out from perforated, indented or weakened areas) and then folded back and passed through an opening in the box so that the first part projects out from the box. The box is then placed flat with the first part projecting upward or the box is placed on a side with the first part projecting outward. One or more pieces of the box are then cut out from the remainder of the box and an opening is provided through the piece(s) so that it can be thrown in an effort to have the opening receive the first part; i.e., so that the piece ends up on, around, or over the first part encompassing it. In one particular aspect several throwing pieces are cut from the box. In another aspect additional parts like the first part are cut from the box and folded and positioned to provide several projecting parts at which the throwing pieces may be directed. The throwing pieces may have any suitable shape as viewed from above (e.g., but not limited to, square, rectangular, round, oval, triangular, pentagonal, hexagonal, irregular, etc.) and the openings through the throwing pieces may also be any suitable shape—either a shape corresponding to the shape of the throwing piece or not. In other aspects, the throwing pieces are made from a single thickness of a box; and in some aspects throwing pieces are made from two or more thicknesses of a box.

In another embodiment, a portion of the box is separated from the box to provide a target opening for items thrown at the box. An object or objects for throwing at the box may be made from the box itself, from another box, or other object(s) may be used. In one aspect a flyer disc as disclosed herein is made from a box and then thrown at the target opening of a box. In another aspect, a plurality of flat discs or objects of non-round shape are made from the box from which the target opening was taken and these discs or objects are then thrown at the target opening. In one aspect, one or more parts of the box are totally or partially separated from the box, folded, and then an end thereof is inserted into one or more openings, slots, slits, or cuts in the box to stabilize the remainder of the box with the target opening. One, two, or more target openings may be provided in a single box—with multiple openings on one side of a box or with openings on two, three or more sides of a box. In one particular aspect corresponding openings are provided on two sides of a box, e.g., but not limited to, on two sides of a pizza box so that an object can be thrown so that it goes through both openings. In other aspects a box with a target opening is positioned or is laid flat so that thrown objects that pass through the target opening enter the box and remain there.

In other aspects, one or more knock-down items, in one embodiment in the general outline shape of bowling pins, are made from a box or boxes and, optionally, an object to throw or roll at them to knock them down is also made from the same box or boxes or from another box. By using multiple discs separated from a box or boxes and then meshed together using slots in each disc, a generally spherical object is made that will roll when thrown along a floor or other surface. In another aspect a cubical throwing item (or or items) is made from a box or boxes.

In one particular aspect a set of dominoes or checkers is printed on the box or a paper with a set of dominoes or checkers printed thereon is glued or attached to the box. The dominoes or checkers are then separated from the box to provide a set of dominoes for playing domino games or checkers for playing a checkers game. In one aspect, a checkerboard may be printed on a box or on a sheet of paper glued to the box. Checkers may be played on such a checkerboard that remains on the box or the checkerboard may be separated from the box. A checkerboard may be made on one box and the checkers separated from another box or both may be made from a single box. In a particular aspect of the present invention, game pieces such as dominoes, chess pieces, or checkers are printed on one surface of a part of a box and, optionally, a logo, trademark, tradename, symbol, word(s), motto, or other indicia are printed on a reverse surface so that when the game pieces are separated from the box each has the logo, etc. on one side and the game indicia on the other. For game pieces such as checkers, the logo, etc. may be provided on both sides or on only one side.

The present invention, in certain embodiments discloses a flying disc made from cardboard, plastic or similar material which is sufficiently rigid so that a disc body of the material will be flat or substantially flat in flight. In certain aspects the disc is generally square, rectangular, triangular, pentagonal, quadragonal, hexagonal, septagonal, octagonal, oval, or circular as viewed from above, but it may have any shape which serves as the body for the flying disc. In certain aspects, a portion or portions around the disc periphery are bent down. In one aspect these portions extend continuously completely around the discs perimeter. These portions may be bent down and not be in contact with, not be interconnected or interlocked with adjacent portions; or, alternatively, these portions may contact each other, be taped together, be interconnected, and/or be interlocked with each other.

In one aspect such a disc is made by cutting out or punching out a disc piece of plastic, fiberboard, kraft paper, cardboard, etc. with the desired shape from a larger piece thereof. Slits, weakened areas, grooves, indentations, and/or cuts are then made around the discs perimeter (or this may be done before the disc piece is cut or punched out from the larger piece of material). A portion or portions of the disc (one, two, three, four, five, six, seven, eight, nine, ten, eleven, twelve, or more) between pairs of slits, etc. are then folded down. Alternatively, weakened or slit lines on top of the disc around its circumference provide a line down from which a part of the disc body can be bent or folded to provide the portion or portions projecting down from the disc body to facilitate its flight. In one particular aspect this produces an intermittent lip around the disc perimeter that facilitates the flight of the disc (as compared to a flat piece of material with no such lip or portions).

In one embodiment two (or more) discs are connected together. In one such multi-disc assembly, two such discs are completely removed from a box or boxes and are then connected face-to-face so that the slits or cuts in the downward projecting edge of one disc are offset from those of the other disc. In another aspect a first disc with the intermittent lip of folded-down portions is connected to and on top of a disc (or discs) with no such portions. In another aspect two discs or other items of similar shape when viewed from above are almost totally separated from a single box and a small part of the box is left between the two items. One item is then folded over the other using the small part as a connector and as a hinge portion. In one aspect of such a folded-over compound disc (or other shaped item), one of the discs is smaller than the other and a tab in the smaller disc is insertable into an opening in the larger disc to join them together.

In another embodiment a secondary piece of material, is connected face-to-face, on top of or beneath, a disc as described above. Such a secondary piece adds weight to the disc and facilitates its flight with the lip of the disc on the lower side of the disc in flight. Alternatively any weight or weights may be connected to a disc to facilitate its flight.

In one particular embodiment the cardboard (or paper, paperboard, etc.) used to produce a disc according to the present invention is cut out of or separated from a box, as may be the secondary piece, or multiple discs of a multi-disc disc.

The disc and/or secondary piece may be cut from any suitable cardboard, foam board, thick paper, plastic, rigid material, or box or container made from these materials. In a particular aspect the disc and/or secondary piece are cut out or punched out from a pizza box. The outline of the disc body and/or of the secondary piece (and/or of multiple discs) may be printed on the box. Lines may be included to indicate where the material is to be torn or cut to form the portions of the lip that are folded down. Depending on the size of the box, and the desired disc size, multiple discs and secondary pieces may be cut from a single box. Alternatively, a box may be perforated or otherwise cut or weakened along the outlines of the disc(s) and/or secondary pieces to ease separation of them from the box. In certain aspects one or more portions of a secondary piece or of a second disc are formed, sized and configured to engage, interlock with, or fit into corresponding slits, openings, engagement recesses, or locking cutouts on a primary disc body. Such engagement etc. apparatus may be used with or without other ways to fasten a secondary piece or additional disc to a primary disc [including, but not limited to, with glue, adhesive, staple(s), brad(s), screw(s), releasably cooperating hook/loop fastener material [e.g. but not limited to Velcro™ material; tape; and/or string or thread]. Similarly a weight or weights may be connected to a primary disc according to the present invention with or without a secondary piece.

For use in the dark any disc, weight, or secondary piece may have one or more pieces of "glow in the dark" material or reflective material on it and/or one or more light sticks and/or battery or solar powered lights (such items and materials referred to collectively herein as "light material").

In one aspect a box from which a disc or secondary piece is taken may be used as a target container at which a disc or discs are thrown. In one particular embodiment, a box or part of a box from which a disc is taken is used as a target. In one aspect, the newly-created opening (from which the disc was removed) is used as a target. In one aspect one or more additional discs is cut out or punched out from a first disc so that a smaller disc (or discs) is created that can more easily fly through the box opening corresponding to the first disc.

In one particular aspect of the present invention a dual disc includes a first disc with a disc body with a peripheral lip and a groove or recess in the lip. This groove or recess is configured and sized for releasable receipt therein of the lip of a second disc. In one aspect such a dual disc combination is used as a container for an object or objects in a space between the two discs.

In another embodiment a primary disc has within it a secondary disc that can be cut out, punched out, or otherwise separated from the primary disc. The secondary disc has one, two, three, four or more tertiary discs separable from the secondary disc. In a particular aspect the primary disc's opening from which the secondary disc was removed is used as a target at which the tertiary discs are thrown. In another particular aspect the secondary disc is used as a base for the primary disc to present a stand-up target for the secondary disc (or vice versa, primary disc as base, secondary disc as target). Either a disc opening may be used as a target or a disc may be a "knock-down" target with the object to knock over a disc that is standing up. Any suitable connection of the two discs (primary and secondary) may be used, including, but not limited to, the ways described above for connecting or attaching a secondary piece to a primary disc. In one aspect a secondary disc has a slit and a portion of a primary disc is inserted into the slit (or vice versa) so that the secondary disc serves as a base for the primary disc to hold the primary disc upright. Alternatively the primary disc and secondary disc (or three, four or more discs) are upright and lean against each other to present a target, target opening, and/or knock-down target.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious games and play activities in which game pieces, activity objects, and/or targets and/or knock-down items etc. are made from a single box or several boxes;

Such a game or activity in which an extending part of a box is made from the box so that it projects therefrom to provide a target at which objects are thrown that have an opening that can encompass the extending part, and such objects that are also made from the box or boxes;

Such a game or activity in which one or more target openings are made in a box and then objects are thrown in an effort to have them pass through a target opening, and such games or activities in which the thrown objects are themselves made from the box or boxes;

Such a game or activity in which one or more gameboards and/or one or more game pieces are made from a box or boxes;

Such games or activities in which the box or boxes used are pizza boxes, and, in one aspect, a single pizza box is used to produce a target and one or more throwing objects.

New, useful, unique, efficient, nonobvious flying discs;

Such flying discs which include a primary disc and/or a secondary piece;

Such flying discs with two flat parts connected together or such flying discs in which one or more portions thereof are folded or bent down from a main disc body; and, in one particular aspect, such flying discs in which every other portion is folded down;

Such discs taken from a larger piece of material;

Two or more such discs taken from a larger piece of material;

One such disc serving as a support or base for another; and/or

One such disc serving as a target.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1A is a top plan view of a flying disc according to the present invention. FIG. 1B is a side view of the disc of FIG. 1A. FIG. 1C is a side view of the disc of FIG. 1A with portions folded down.

FIG. 2A is a top plan view of a flying disc according to the present invention. FIG. 2B is a side view of the disc of FIG. 2A. FIG. 2C is a side view of the disc of FIG. 2A with portions folded down.

FIG. 3A is a top play view of a flying disc according to the present invention. FIG. 3B is a top plan view of a secondary piece for a multi-part disc according to the present invention. FIG. 3C is a side view of a multi-part disc according to the present invention with the flying disc of FIG. 3A and secondary piece of FIG. 3B.

FIG. 4A is a perspective view of a flying disc according to the present invention showing the top of the box. FIG. 4B is a side view of the disc of FIG. 4A.

FIG. 5 is a top plan view of a flying disc according to the present invention.

FIG. 6 is a top plan view of a flying disc according to the present invention.

FIGS. 7A–7E are a top plan views of a flying discs according to the present invention.

FIG. 8 is a bottom view of a flying disc according to the present invention.

FIG. 9A is a side view of a flying disc container system according to the present invention. FIG. 9B is a side view of a flying disc of the system of FIG. 9A.

FIG. 12A is a perspective view of a box according to the present invention showing the top of the box. FIG. 12B is a perspective view of a box of FIG. 12A open with parts removed. FIG. 12C is a plan view of the box of FIG. 12A unfolded and flat. FIG. 12D is a top view of a disc and a secondary piece removed from the box of FIG. 12A.

FIG. 13 is a side view in cross-section of a flying disc container according to the present invention.

DESCRIPTION OF EMBODIMENTS PREFERRED AT THE TIME OF FILING FOR THIS PATENT

Figure 10A:
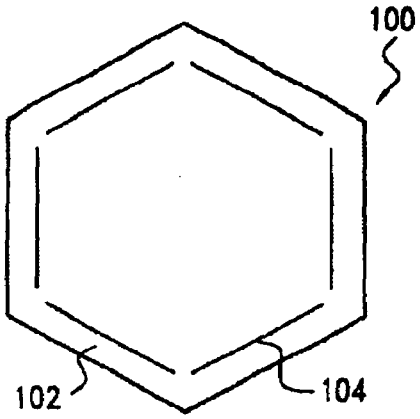
FIG. 10A is a top view of a flying disc according to the present invention.

Referring now to FIGS. 1A–1C, a flying disc 10 has a disc body 12 which is generally circular as viewed from above as in FIG. 1A. The disc body 12 has a plurality of spaced-apart slits 14 which go all the way through the disc body 12 (but which, according to the present invention, may be made so that they do not cut completely through the disc body 12). As shown in FIG. 1C, portions 16 of the disc body 12 between pairs of slits 14 have been bent down forming a downwardly projecting lip 18 around the perimeter of the disc body 12. Although the portions 16 are shown folded down in a scalloped arrangement (one side of a portion overlapping the adjacent portion), they may be folded down with two sides of one portion both overlapping adjacent portions. Also, as with any disc herein, if the slits 14 do not extend completely through the body 12, the portions 16 may be folded either way with respect to the slits 14; i.e., e.g. in FIG. 1B the portions 16 may be folded up or down. It is also within the scope of this invention to fold one or more portions 16 up and one or more down or to alternate up-down portions around a disc's perimeter.

The disc body 12 (and any disc body herein) may be made of any suitable material. For a circular disc (as viewed from above) any disc body disclosed herein and any circular secondary piece or disc may be any desired diameter. In certain aspects the disc body (and any disc body herein) is made of typical cardboard about one fourth of a centimeter or about one half of a centimeter thick which has an internal support structure, e.g. as the common cardboard used in typical cardboard boxes.

FIGS. 2A and 2B show a flying disc 20 according to the present invention which has a disc body 22 and spaced-apart slits 24. As shown in FIG. 2C portions 26 between pairs of slits 24 have been folded down to form a peripheral lip 28.

FIG. 3C shows a flying disc 30 according to the present invention which has a primary disc 31 with a disc body 32 and a plurality of bent down portions 33 between spaced-apart slits 34. Attached to or held within an underside of the disc body 32 is a secondary piece 35 (shown as circular in shape as viewed from above as in FIG. 3B, but which may be any desired shape). Staples 36 are shown connecting the secondary piece 35 to the disc body 32; but it is within the scope of this invention to use any suitable adhesives, glues, tapes, brads, nails, releasably cooperating hook-and-loop material, and/or mechanical connectors to connect the secondary piece to the disc body; and/or to fold the portions 33 so that the secondary piece is held within them; and/or to tape together, connect together, and/or interlock the portions 33 together to hold the secondary piece in place; and/or to attach, adhere, or connect the secondary piece to one, two, or more, or all of the portions 33. The secondary piece may be for facilitating flight of the disc 30/piece 35 and/or may have indicia and/or advertising thereon. In one particular embodiment in which a primary disc is cut from a cardboard box of cardboard about a quarter inch thick, the disc body is about ten and three-quarters inches in diameter and the secondary disc is about nine inches in diameter with the folded portions (eleven of them) between three-and-a-half and two inches long and about an inch wide; and two staples hold the two discs together.

As shown in FIGS. 3A and 3B the secondary piece 35 (and any disc or secondary piece herein) may have one, two (as shown) three, four or more tabs 37 which fit into corresponding slits or openings 38 on a primary disc 31 to hold the secondary piece to the primary disc. Such tab/slit apparatus may be used with or without staples 36 or other adhesives, connectors, etc.

FIGS. 4A and 4B show a flying disc 40 according to the present invention with a disc body 43 and a plurality of spaced-apart folded-down portions 46 around the disc perimeter. Portions of the disc body 42 are torn, cut or otherwise removed to permit the folding of the portions 44.

FIG. 5 shows a flying disc 50 with markings or slits 54 around a perimeter of a disc body 52. Portions 56 can be folded down (or up) from the disc body 52 to form a peripheral lip.

FIG. 6 shows a flying disc 60 with markings or slits 64 around a perimeter of a disc body 62. Portions 66 can be folded down (or up) from the disc body 62 to form a peripheral lip.

FIGS. 7A–7E show a variety of flyers with various shapes 71–75, respectively, as viewed from above for flyers according to the present invention and any flying disc herein may have any of these shapes as well as the shape of any desired polygon.

FIG. 8 shows a flying disc 80 according to the present invention which may be any flying disc or flyer disclosed herein. The flying disc 80 has a disc body 82 to which are attached one, two (as shown), three, four or more weight members 83. It has been found that some disc bodies fly better with added weight and/or with an added secondary piece (e.g. as in FIG. 3C). Any weight member may be connected to or attached to a disc body with any attachment, or connection disclosed herein or with any suitable known securement apparatus, device, or method.

FIG. 9A shows a flyer container 90 according to the present invention which has a lower box part 91 for containing an item 99 and an upper flying disc part 92 hingedly connected to the lower box part 91 with a hinge 93. The hinge 93 may be an easily severable or tearable hinge made, e.g., of paper, cardboard, or plastic so that the disc part 92 is separable from the lower box part 91. Alternatively, the lower box part 91 is also a flying disc. The disc part 92 and the lower box part 91 may be any desired size and have any desired dimensions. The item 91 may be any item that fits within the flyer container 90, including, but not limited to, pastries or pizza. In one aspect the entire container 90 is made of plastic in a single mold with either an easily separable etc. hinge as described above or with a sturdier hinge that is not so easily separable.

Figure 10B:
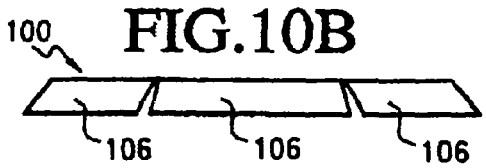
FIGS. 10B and 10C are side views of the flying disc of FIG. 10A.
Figure 10C:
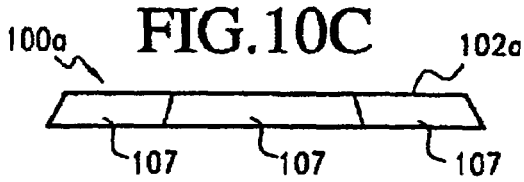

FIG. 10A shows a flying disc 100 with a disc body 102 and markings or slits 104. As shown in FIG. 10B the disc body 102 has been torn or cut and portions 106 have been folded down forming a peripheral lip 108. As shown in FIG. 10C, a flying disc 100*a* has a disc body 102*a* (like the disc body 102, FIG. 10A) that has not been cut or torn and portions 107 have been folded down to form a peripheral lip 109. As may be done with any disc or flyer disclosed herein, FIG. 10C shows that the markings or slits may be eliminated.

FIGS. 11A–11D show multi-disc combinations which each include two flying discs (which may be generally like any flying disc or flyer disclosed herein or in the prior art cited herein, but with the particular disclosed structure for releasably mating together two discs or flyers).

Figure 11A:
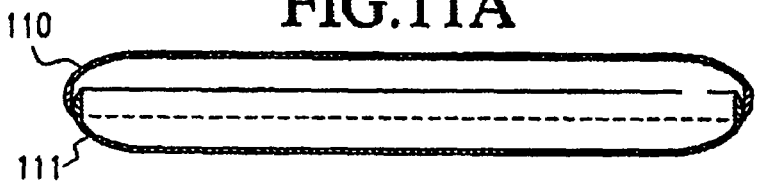
FIGS. 11A–11D are side views in corss-section of flying disc systems according to the present invention.
Figure 11B:
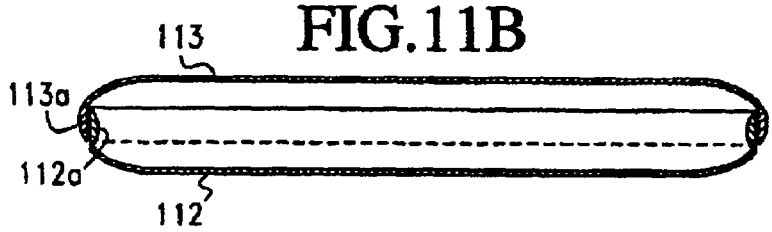

As shown in FIG. 11A a periphery of a flying disc 110 is releasably held by friction fit within a periphery of a slightly larger flying disc 111. As shown in FIG. 11B a lower flying disc 112 has a flattened outer portion 112*a* that abuts a corresponding flattened inner portion 113*a* of a flying disc 113 so that the flying disc 112 is releasably held by a friction fit within the flying disc 113.

Figure 11C:
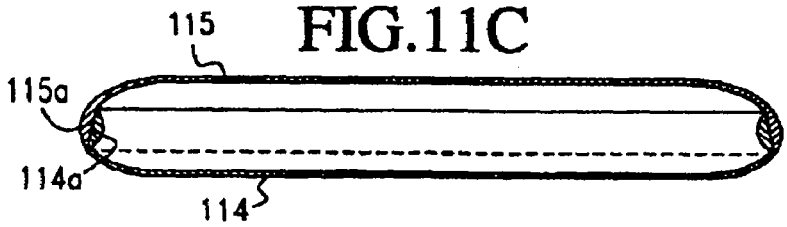

As shown in FIG. 11C a flying disc 114 has a flattened tapered outer portion 114*a* that abuts a corresponding flattened tapered inner portion 115*a* of a flying disc 115 so that the flying disc 114 is releasably held by a friction fit within the flying disc 115.

Figure 11D:
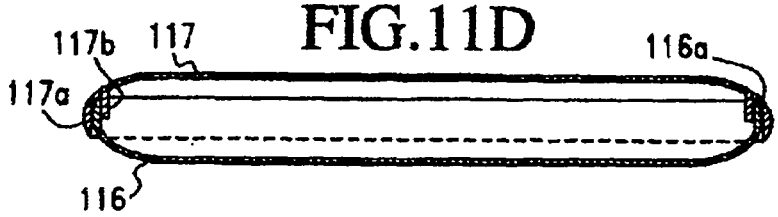

FIG. 11D shows a flying disc 116 with a portion 116*a* releasably held by a friction fit between a portion 117*a* and a portion 117*b* of a flying disc 117. The portion 117*b* may extend around the entire circumference of the disc 117 or two or more spaced-apart parts 117*b* may be used to hold the discs together.

FIGS. 12A–12C show a box 120 according to the present invention which has a box body 122, which may according to the present invention be a unitary structure as shown in FIG. 12C that is fordable into a box or the box 120 may be made of separate pieces of material, e.g. but not limited to, cardboard. As shown in FIGS. 12A and 12C the box is marked with markings 120*a* and 120*b* to indicate the boundaries of a flying disc 124 removable from a top 120*c* of the box and a secondary piece (or additional flying disc) 126 removable from a bottom 120*d* of the box 120. One of the flying disc 124 and the secondary piece (or disc) 126 may be smaller than the other so that, as shown in FIG. 12B, the box top 120*c* may be in an upright position to serve as a target at which (and/or through which) a flying disc, e.g. but not limited to, a secondary piece 126 used as a disc may be thrown. Also, the box itself may be a target into which a disc is thrown. Any disc removed from the box may be reduced in diameter to easily pass through a box opening and/or any opening may be enlarged for this purpose.

In one aspect the secondary piece 126 serves as a secondary piece 35 (in FIGS. 3B, 3C). The box 120 may be any known box from which it is possible to form or remove the disc 124 and/or the secondary piece or disc 126. In one particular aspect, the box 120 is sized and configured to be a box for pizza. The box may be (but is not limited to) any box disclosed in any of U.S. Pat. Nos. 6,206,277; 5,595,339; 6,065,669; D 420,583; and all the prior art cited in all these patents—all of which is incorporated fully herein for all purposes. Any desired number and size flying discs and/or secondary pieces or discs may be made of or removed from a single box.

FIG. 13 shows a flyer container 130 which may be any shape disclosed herein as viewed from above and which has a part 131 with an outer portion 133 and an inner portion 134 between which is releasably held by a friction fit an outer part 136 of a flying disc 132.

Figure 14:
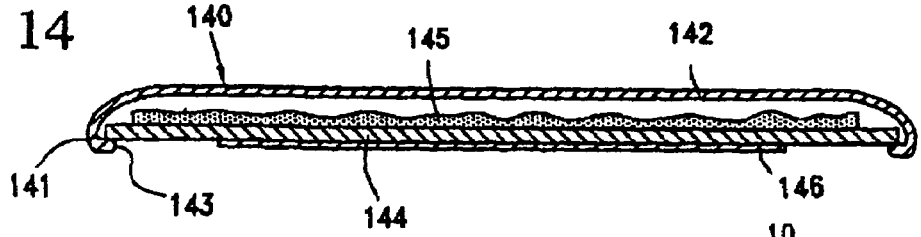
FIG. 14 is a side view in cross-section of a flying disc container according to the present invention.

FIG. 14 shows a flyer container 140 which may be any shape disclosed herein as viewed from above and which has a part 141 of a flying disc 142 with a lip 143. Releasably held within the flying disc 142 is a support 144 whose bottom rests on the lip 143. By flexing the flying disc 142 and/or the support 144, the support is releasably from within the flying disc 142. An item 145, e.g. but not limited to, pastry, or pizza rests on the support 144. The lip 143 may, according to the present invention, be eliminated, and the support 144 held in place by a friction fit between it and the interior of the disc 142.

Any layer or layers of insulating material 146 as shown in FIG. 14 may be used with any flying disc or flyer or container disclosed herein. Any layer or layers 146 in FIG. 14 (or all of them) may be deleted. A middle layer like the middle layer 146 in FIG. 14 may surround the item 145.

Any two flying discs and/or flyers according to the present invention which are appropriately sized and configured may, according to the present invention, be nested one inside the other either for shipment of for use and, in one particular aspect, two such discs and/or flyers are connected together for use, e.g. but not limited to, with staples, tape, or any other connector or connecting method disclosed herein.

Figure 15A:
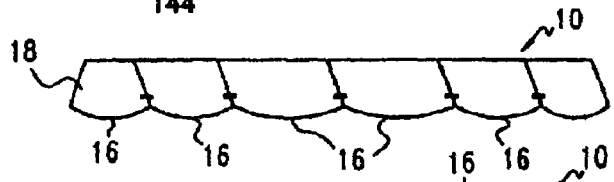
FIGS. 15A and 15B are side views of flying discs according to the present invention.
Figure 15B:
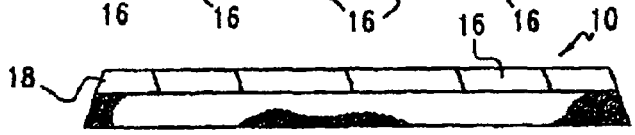

FIGS. 15A and 15B present other versions of the disc 10 of FIG. 1A. As shown in FIG. 15A staples 150 pass through overlapping parts of adjacent portions 16 of the disc 10. These staples hold the portions 16 together (and are used for some or all adjacent portions to connect some or all of them together) and prevent the portions 16 from moving, flopping around or bending back toward or to their original position. Any such portions of any disc or flyer according to the present invention may be thus connected with staples (or alternatively brads, clips, paper clips or other similar connectors).

As shown in FIG. 15B, the disc 10 has tape 152 that is taped around the disc's circumference to tape together the portions 16. Any such portions of any disc or flyer herein may be thus taped together.

Figure 16A:
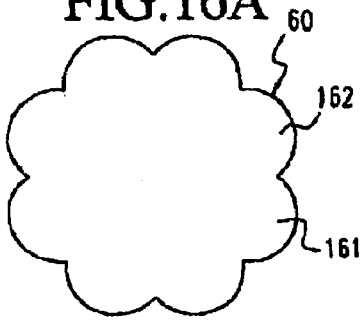
FIGS. 16A, 16B, 17A, and 17B are top views of flying discs or flyers according to the present invention.
Figure 16B:
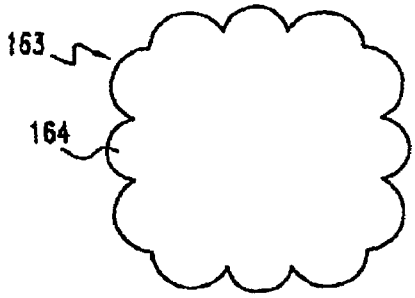

FIG. 16A shows a flying disc 160 according to the present invention with a disc body 162 and a plurality of spaced-apart portions 161 that are to be folded down (e.g. like any folded down or bent down portions of any disc or flyer herein). FIG. 16B shows a flyer 163 according to the present invention with a plurality of spaced-apart portions 164 that are to be folded down like the portions 161, FIG. 16A. Any flyer or disc herein may have any desired number of portions like those of FIG. 16A (portions 161) or FIG. 16B (portions 164). Although these portions are shown as generally "scalloped" shape or semicircular, they may be any desired general shape, including but not limited to, triangular, square, or rectangular.

Figure 17A:
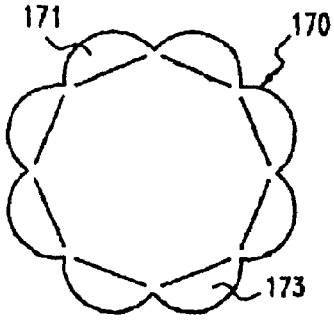
Figure 17B:
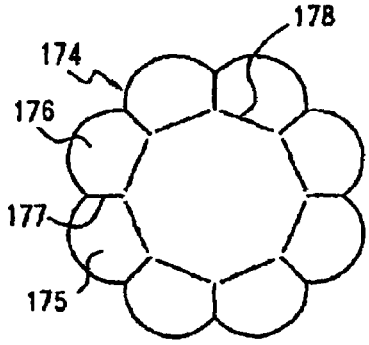

FIG. 17A shows a flying disc 170 with portions 171 (like the portions 161, FIG. 16A) whose folding or bending is facilitated by indentations or incomplete (not all the way through a disc body 172) cuts or grooves 173. Alternatively the indentations, etc. are replaced by lines or markings indicating where the portion is folded or bent. FIG. 17B shows a flying disc 174 with a disc body 175 and spaced-apart portions 176 (like portions 171, FIG. 17A). Indentations or cuts 177 separate the portions 176 and markings 178 (or cuts or indentations) indicate where the portions 176 are to be folded or bent. Any disc or flyer herein may employ similar suitable indentations 177 and/or markings (or cuts) 178.

The present invention, therefore, provides in certain, but not necessarily all embodiments, a flying disc with a disc body having an outer perimeter and, optionally, a plurality of cuts spaced-apart around the outer perimeter, at least one portion of the disc body between at least one pair of the cuts, the at least one portion folded at an angle to, up from or down from the disc body, or without such cuts but with one or more folded down portions; and/or a disc body having an outer perimeter and a plurality of portions of the disc body folded down from the disc body around the outer perimeter. Such a flying disc may also include one, some (in any possible combination) or all of the following: a secondary piece (or pieces) or disc (or discs) connected to an underside or top side of the disc body; wherein the secondary piece is connected to the disc body with at least one staple, with adhesive, or tape; wherein the secondary piece is for facilitating flight of the disc body and has indicia or advertising thereon; wherein the secondary piece is shaped similar to the disc body; wherein the secondary piece has at least one tab and the disc body has at least one slit or opening corresponding to the at least one tab, the at least one tab insertable into the at least one slit to connect the secondary piece to the disc body, or with tab(s) on the disc body and corresponding slit(s) or openings(s) on the secondary piece; wherein the at least one tab is at least two spaced-apart tabs and the at least one slit is at least two spaced-apart slits, one slit corresponding to each tab; wherein the at least one portion is a plurality of adjacent portions, the at least one pair of cuts is a plurality of pairs of cuts, each portion of the plurality of adjacent portions folded between a pair of the cuts (cuts completely through the disc body or only extending partially thereinto); a secondary piece connected to an underside of the disc body, the secondary piece for facilitating flight of the disc body and/or for bearing indicia and/or ads material, and the secondary piece positioned within the adjacent portions that are folded down; wherein the disc body has a shape as viewed from above from the group consisting of triangular, rectangular, square, pentagonal, hexagonal, septagonal, octagonal, nonagonal, decagonal and polygonal; at least one light or piece of light material on the disc body; a piece of material larger than the disc body from which the disc body is separatable, e.g., but not limited to part of a box, e.g. but not limited to a cardboard box; wherein the cardboard box is for holding a pizza; wherein the piece of material is suitable as a target at which and/or into which the flying disc or any disc is thrown; wherein the flying disc is made of rigid material from the group consisting of paper, cardboard, plastic, metal, foil and foamboard; a secondary flying disc removed from the disc body; wherein the secondary flying disc has a disc body having an outer perimeter and a plurality of cuts spaced-apart around the outer perimeter, and portions of the disc body between pairs of the cuts, the portions folded down from the disc body; at least one tertiary disc removed from the secondary flying disc; wherein the at least one tertiary disc has a disc body having an outer perimeter and a plurality of cuts spaced-apart around the outer perimeter, and portions of the disc body between pairs of the cuts, the portions folded down from the disc body; wherein the at least one tertiary disc is a plurality of tertiary discs; wherein the secondary piece has an opening therein suitable for receiving and holding a portion of the disc body to form a disc body—secondary piece combination so that one of the disc body and secondary piece is held upright; and/or wherein the secondary flying disc has an opening therein suitable for receiving and holding a portion of the disc body to form a disc body—secondary flying disc combination so that one of the disc body and flying disc piece is held upright.

Figure 18A:
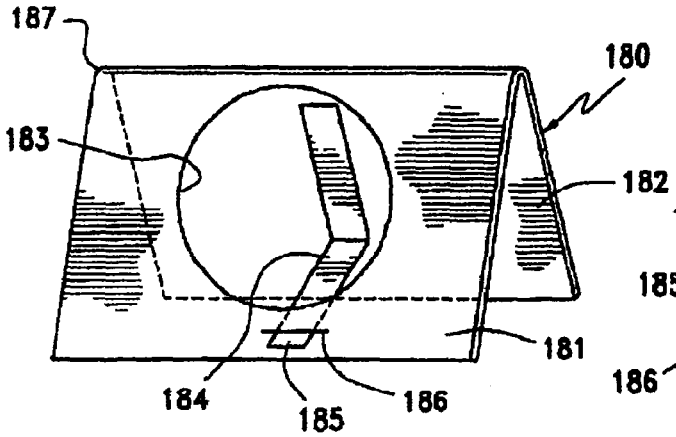
FIG. 18A is a perspective view of a target according to the present invention.
Figure 18B:
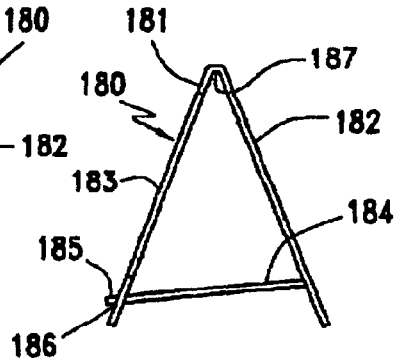
FIG. 18B is a side view of the target of FIG. 18A.

FIGS. 18A and 18B show an upstanding target 180 made from a box with (at least) two opposed sides 181, 182 connected together with a box part 187. A target opening 183 is removed or cut from the side 181. A strip 184 is cut from the side 182 and an end 185 of the strip 184 is inserted through an opening, slot or slit 186. The end 185 may be turned down or twisted to maintain the strip 184 in place. The sides 181, 182 and box part 187 may be of any suitable box material, including, but not limited to cardboard, paperboard, fiberboard, foamboard, craft paper, and manila paper—as may be any box or box part disclosed herein. Alternatively (as may be the case with any box or target disclosed herein), openings may be made in opposed box sides and a piece (or pieces) of box material may be used that passes through each opening. Such a piece of box material is completely separated from a box and is then passed through openings in each of the opposed box sides.

The strip 184 is shown generally centrally located, but it is within the scope of this invention to locate it at any suitable place on the side 182 and/or to use two, three or more such strips. It is also within the scope of this invention to cut one or more such strips from the side 181 and have its (or their) end inserted through a slit, etc. in the side 182. The strip(s) 184 may be any desired length and the target opening 183 may be any desired shape and size (as may be the case with any opening and target disclosed herein). It is within the scope of this invention to provide a box side with two, three, four or more target openings and to provide segmented openings (e.g. see FIG. 21A) (as may be the case with any opening and target disclosed herein).

Figure 19A:
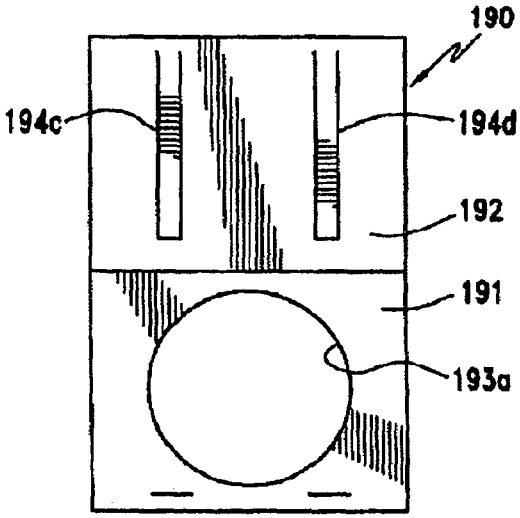
FIG. 19A is a top view of a box for making a target according to the present invention.
Figure 19B:
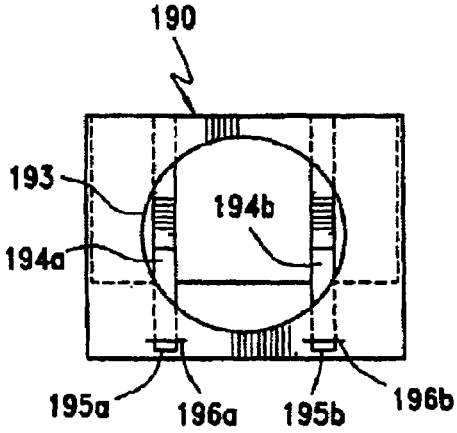
FIG. 19B is a perspective view of a target according to the present invention made from the box of FIG. 19A.

FIGS. 19A and 19B show a target 190 made from a single box which has (at least) two sides 191, 192. A target opening 193 is cut or removed from the box side 191 (indicated by a line 193*a* in FIG. 19A) and two strips 194*a*, 194*b* are cut or removed from the box side 192 (indicated by lines 194*c*, 194*d*, respectively in FIG. 19A) with an end thereof remaining as an integral part of the box side 192 (as is the case with the strip 184, FIG. 18A). Ends 195*a*, 195*b* are inserted through openings 196*a*, 196*b* respectively, and the target 190 can assume an upright position (like the target in FIG. 18B).

Figure 20A:
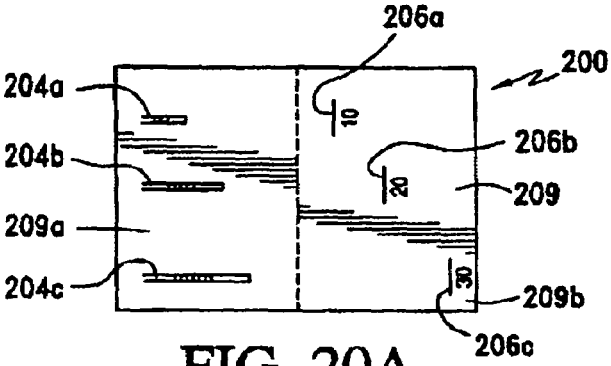
FIG. 20A is a top view of a box for making a target according to the present invention.
Figure 20B:
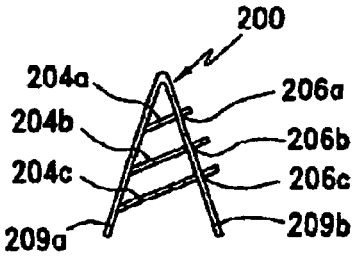
FIG. 20B is a side view of the target of FIG. 20A.

FIGS. 20A and 20B show a target 200 according to the present invention made from box 209 which has three strips 204*a*, 204*b*, 204*c* cut or removed therefrom (with one end remaining integral with the box 209). As shown in FIG. 20B the target 200 is upright with an end portion of each of the strips 204*a*, 204*b*, 204*c* projecting through corresponding openings 206*a*, 206*b*, 206*c*. These projecting end portions provide a projecting target about which a thrown object with a hole therethrough can land, with the hole sufficiently large that the thrown object (which may be any shape disclosed herein as viewed from above with a hole of any shape disclosed herein as viewed from above) can, upon coming to a stop, encompass the projecting end portion of one of the strips 204*a*, 204*b*, 204*c*. It is within the scope of this invention to delete any one or two of the strips 204*a*, 204*b*, 204*c* or to add one, two, three or more such additional strips. Optionally strips may be designated with scoring indicia, e.g. as the strips are designated with "10" "20" and "30" points in FIG. 20A. Sides 209*a*, 209*b* of the box 209 are folded together so the target 200 can stand upright as shown in FIG. 20B.

Figure 21A:
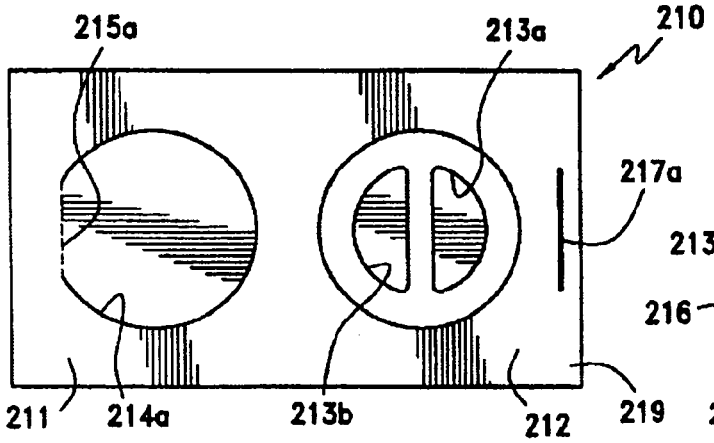
FIG. 21A is a top view of a box for making a target according to the present invention.
Figure 21B:
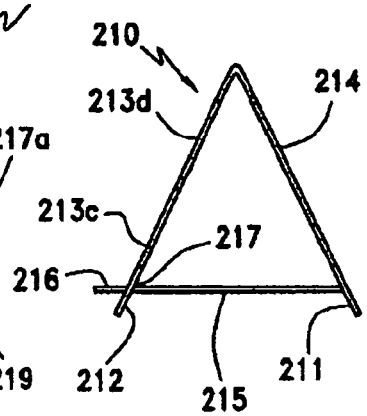
FIG. 21B is a side view of the target of FIG. 21A.

FIGS. 21A and 21B show a target 210 according to the present invention made from a box 210 with (at least) sides 211, 212. Openings 213*d* (FIG. 21B) and 213*c* are made in the side 212 by removing box material within lines 213*b* and 213*a*, respectively, making two target openings. An opening 214 (FIG. 21B) is made in the box side 211 by severing or cutting the box side 211 along a line 214*a*. The resulting box piece 215 still has a part 215*a* integral with the box side 211. As shown in FIG. 21B, the box part 215 has been folded down and its end 216 has been inserted through an opening 217 made along line 217*a* (FIG. 21A). It is within the scope of this invention to provide a target opening with two segments (e.g. like the openings 213*d*, 213*c*) or with three, four or more such opening segments—of which may be any desired shape or size. Alternatively, a single opening may be used instead of the openings 213*d*, 213*c*. In one game or activity an object, disc, etc. is thrown through the opening 214 and one of the openings 213*d*, 213*c*.

Figure 22A:
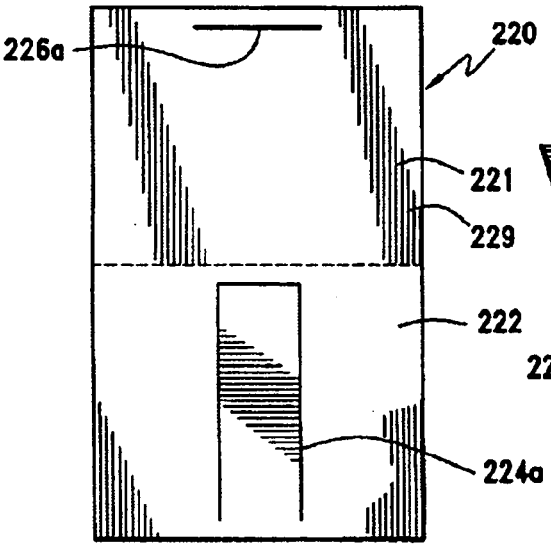
FIG. 22A is a top view of a box for making a target according to the present invention.
Figure 22B:
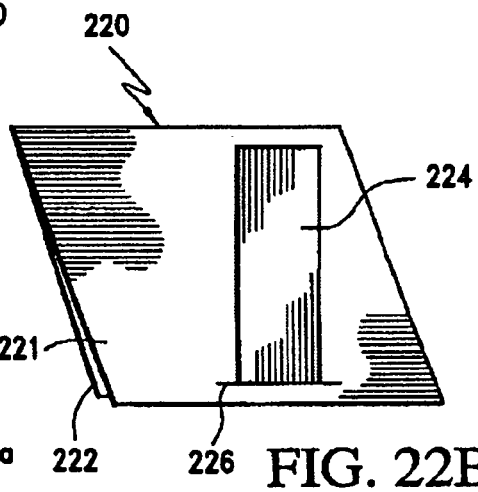
FIG. 22B is a perspective view of a target made from the box of FIG. 22A.

FIGS. 22A and 22B show a target 220 according to the present invention made from a box 229 with (at least) two sides 221, 222. A strip 224 is cut or removed along line 224*a* (FIG. 22A) and is then inserted through an opening 226 (made along line 226*a*, FIG. 22A). With the sides 221, 222 folded together as shown in FIG. 22B the strip 224 projects out from the opening 226. If the sides 221, 222 are laid flat the strip 224 projects up therefrom providing a target about which thrown objects with holes sufficiently large therethrough may land with the object encompassing the strip 224. Points may be awarded (e.g. as in horseshoe games) for objects near the strip 224 and/or for objects encompassing it (as may be the case with any game or activity involving any projecting target and thrown objects disclosed herein).

Figure 23A:
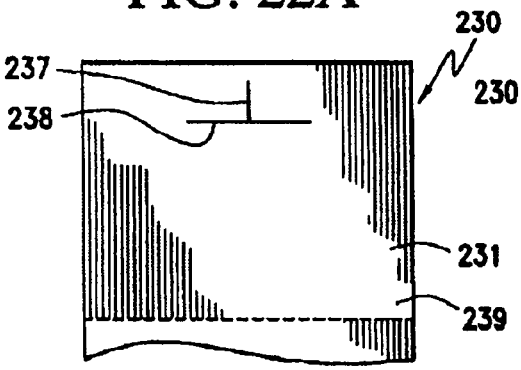
FIG. 23A is a partial view of a box for making a target according to the present invention.
Figure 23B:
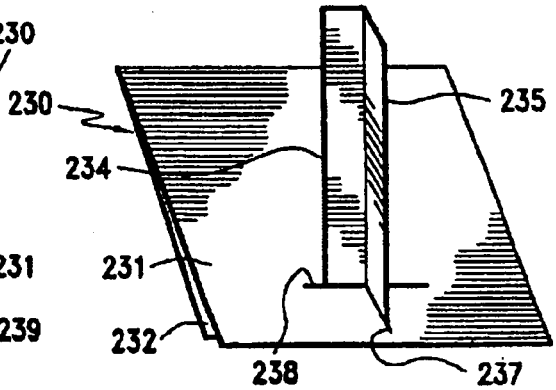
FIG. 23B is a perspective view of a target made from the box of FIG. 22A.

FIGS. 23A and 23B show a target 230 according to the present invention like the target 220 (FIG. 22A); but with a strip 234 (initially like the strip 224, FIG. 22B) having a folded part 235 with an end inserted into an opening 237 which is at an angle (any angle may be used) to an opening 238 through which the strip 234 projects. A box 239 (like the box 229, FIG. 22A) with (at least) sides 231, 232 is used to make the target 230. The sides are folded e.g. as the sides 221, 222 in FIG. 22B.

Figure 24A:
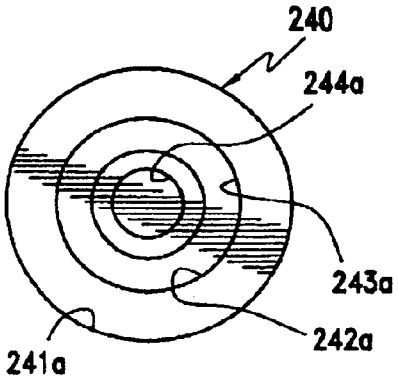
FIG. 24A is a top view of a line pattern for making throwing objects according to the present invention.
Figure 25A:
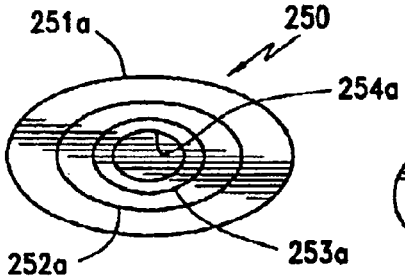
FIG. 25A is a top view of a line pattern for making throwing objects according to the present invention.
Figure 26A:
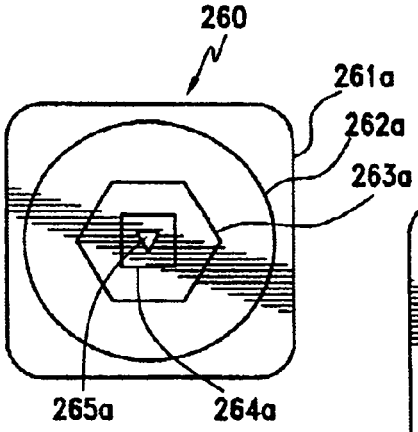
FIG. 26A is a top view of a line pattern for making throwing objects according to the present invention.

FIGS. 24A, 25A, and 26A show the patterns that may, according to the present invention, be applied to any box described or disclosed herein to facilitate the making of throwing objects from such a box.

Figure 24B:
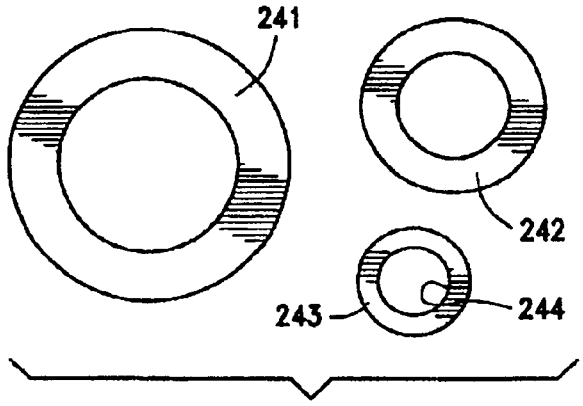
FIG. 24B is a top view of throwing objects made according to the pattern of FIG. 24A.

As shown in FIG. 24B, throwing objects 241, 242, and 243 have been made from a box (not shown) by cutting along or severing along lines 241*a*, 242*a*, and 243*a* of a pattern 240 (FIG. 24A). Cutting along (or severing along) a line 244*a* provides a hole 244 through the throwing object 243.

Figure 25B:
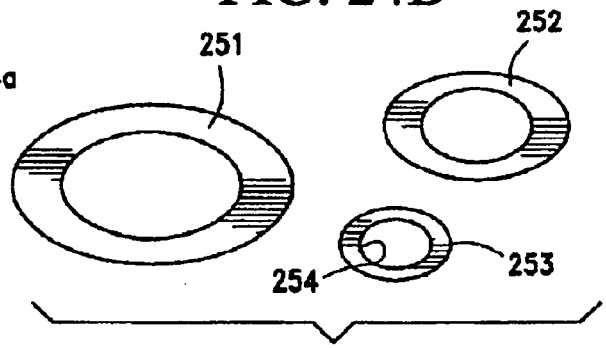
FIG. 25B is a top view of throwing objects made according to the pattern of FIG. 25A.

As shown in FIG. 25B, throwing objects 251, 252, and 253 have been made from a box (not shown) by cutting along or severing along lines 251*a*, 252*a*, and 253*a* of a pattern 250 (FIG. 24A). Cutting along (or severing along) a line 254*a* provides a hole 254 through the throwing object 253.

Figure 26B:
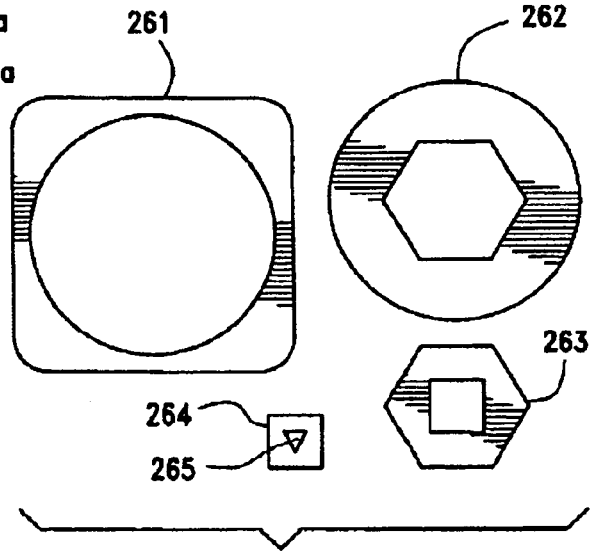
FIG. 26B is a top view of throwing objects made according to the pattern of FIG. 26A.

As shown in FIG. 26B, throwing objects 261, 262, 263, and 264 have been made from a box (not shown) by cutting along or severing along lines 261*a*, 262*a*, 263*a*, and 264*a* of a pattern 260 (FIG. 24A). Cutting along (or severing along) a line 265*a* provides a hole 265 through the throwing object 264.

FIGS. 24A–26B also illustrate that, according to the present invention, any suitable or desirable shape (including, but not limited to any shape referred to herein) may be used for any throwing object according to the present invention and for any hole in any such object. Any of the objects in FIGS. 24B, 25B and/or 26B may, according to the present invention, be used to throw at any target disclosed herein.

Figure 27A:
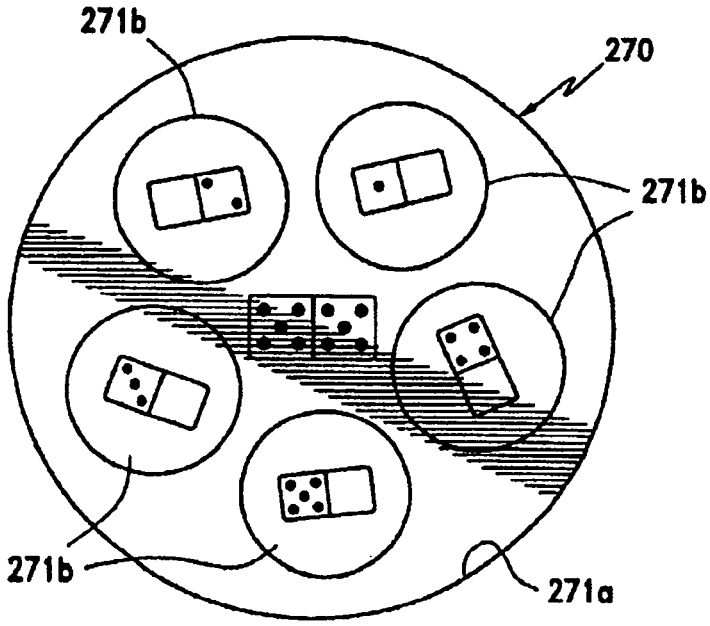
FIG. 27A is a top view of a pattern for a box part for making throwing objects according to the present invention.
Figure 27B:
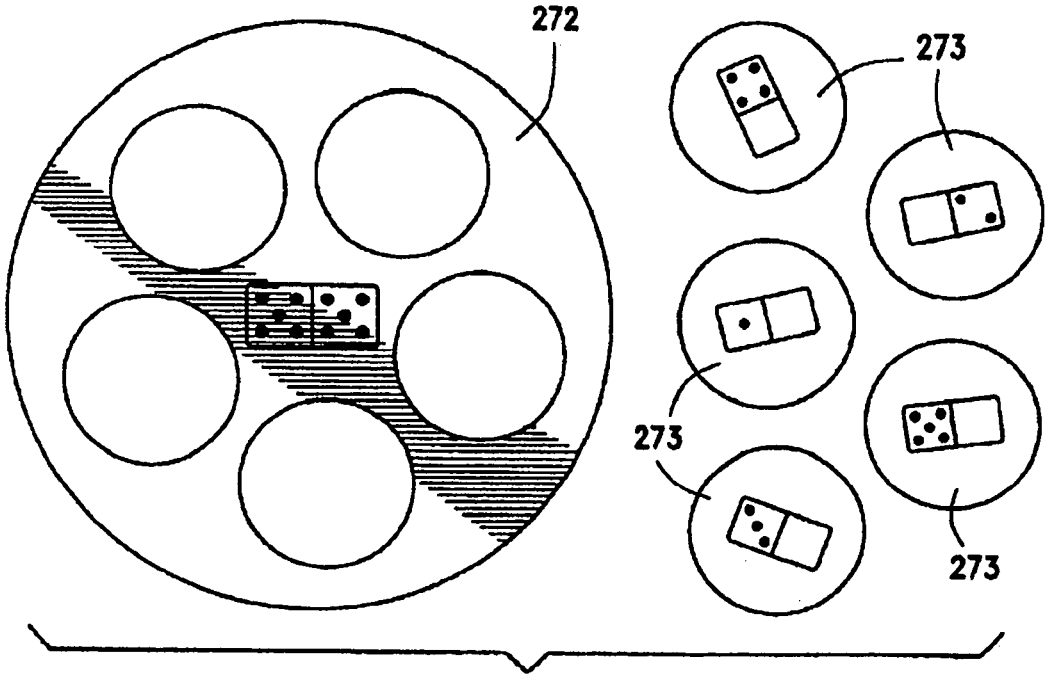
FIG. 27B is a top view of a plurality of throwing objects made with the pattern of FIG. 27A.

FIG. 27A shows a line pattern and scoring indicia indicators (different value domino symbols) for making a plurality of throwing objects (in one embodiment as shown round objects) from part of a box. As shown in FIG. 27B, by severing or cutting a box along lines 271*a* and 271*b* (FIG.

27A) throwing objects 272 and 273 are made. Any suitable scoring indicia may be used, including, but not limited to, words, numerals, symbols, or a combination thereof; and the objects may be any desired shape (including any shape referred to herein). Also, the objects may have a thickness of one part of a box or multiple thicknesses may be used (e.g. attached together with glue, tape, stapes, and/or interfitting parts).

Figure 28A:
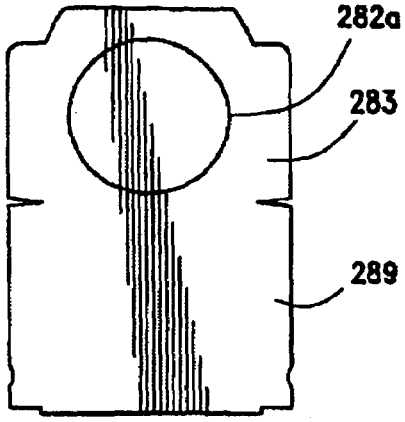
FIG. 28A is a top view of a box for making a target according to the present invention.
Figure 28B:
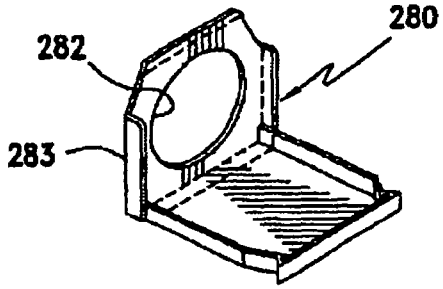
FIG. 28B–28D are perspective views of a target made with the box of FIG. 28A.
Figure 28C:
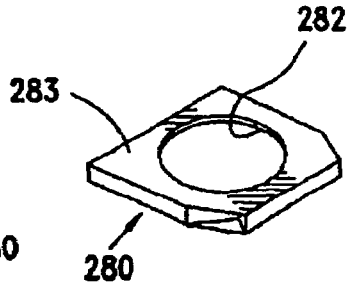
Figure 28D:
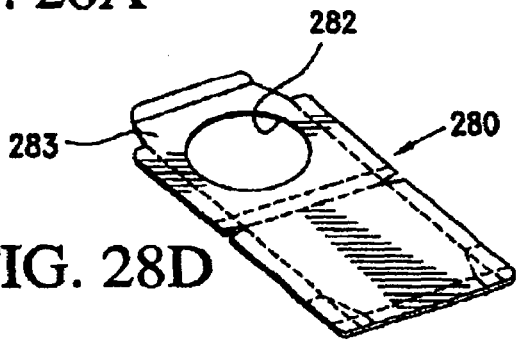
Figure 29A:
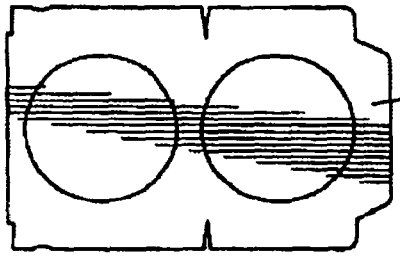
FIG. 29A–29D are top views of boxes for making targets and/or throwing objects according to the present invention.
Figure 29B:
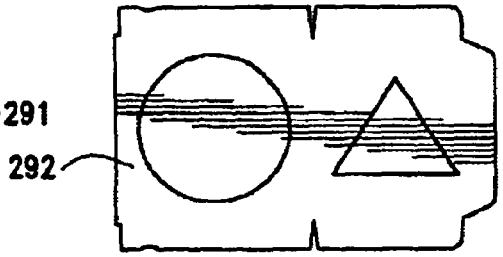
Figure 29D:
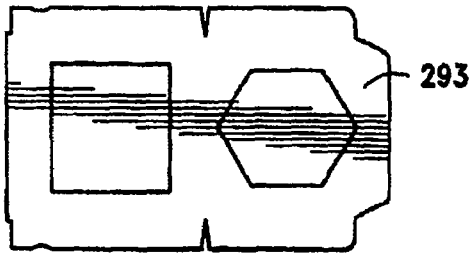
Figure 29C:
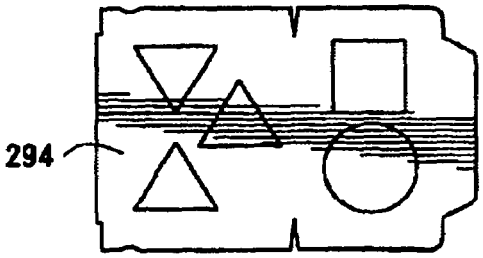

FIGS. 28B–28D show a target 280 which may be made from any suitable box disclosed herein and which, as shown, uses a box 289 as in U.S. Pat. No. 5,702,054 which is fully incorporated herein for all purposes. The target 280 has a hole 282 (cut along line 282*a* of FIG. 28A) made in a lid 283 of the box 289. The hole 282 provides an opening at which thrown objects may be directed. The lid 283 may be positioned in an upright position as in FIG. 28B to provide an upright target or the lid may be closed as in FIG. 28C to provide a flat target. Alternatively, the target 280 as shown in FIG. 28C may be stood upright on one of the thin box edges.

FIGS. 29A–29D show alternative cut-out line patterns for targets 291–294, respectively, that are made by cutting (or severing) openings along the lines within the box outlines in FIGS. 29A–29D. Also, the cut-out parts from the boxes in FIGS. 29A–29D may, according to the present invention, be used as throwing objects to throw at any target disclosed herein.

Figure 30A:
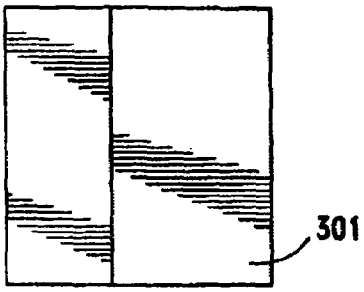
FIGS. 30A, 30B, and 30C are top views of parts of a knock-down item according to the present invention.
Figure 30B:
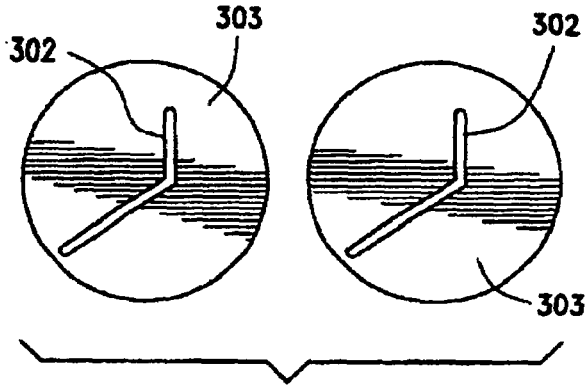
Figure 30C:
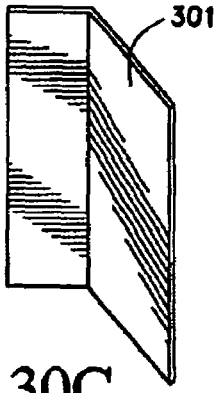
Figure 30D:
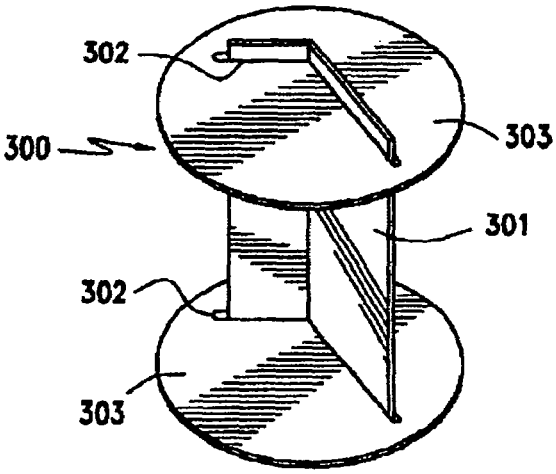
FIG. 30D shows a knock-down item according to the present invention.

FIG. 30D shows a knock-down item 300 according to the present invention made from a folded box part 301 whose ends are inserted through slots 302 in end parts 303. The end parts 303 (also made from a box and which in one aspect are made from the same box as the folded box part) are optional.

Figure 31A:
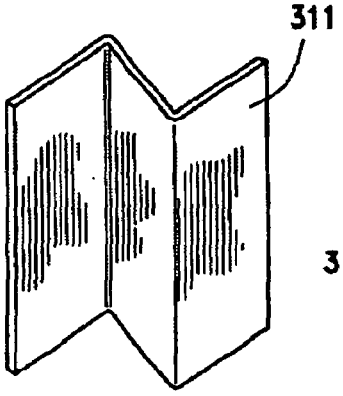
FIGS. 31A and 31B are top views of parts of a knock-down item according to the present invention.
Figure 31B:
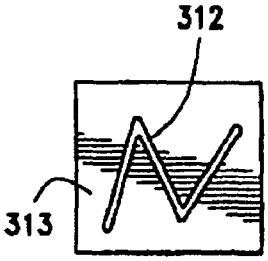
Figure 31C:
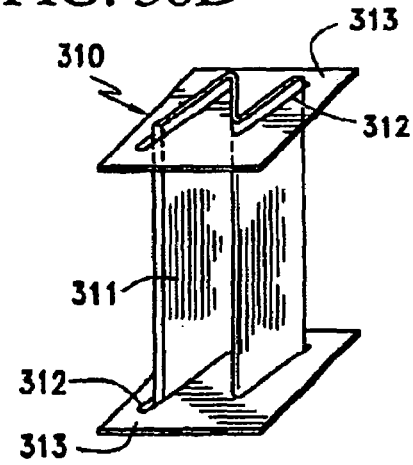
FIG. 31C shows a knock-down item according to the present invention.

FIG. 31C shows a knock-down item 310 according to the present invention made from a folded box part 311 whose ends are inserted in slots 312 in end parts 313. The end parts 313 (also made from a box and which in one aspect are made from the same box as the folded box part) are optional.

Any throwing object according to the present invention may be used in an activity to knock down one or more knock down items like the item 300, FIG. 30D, and/or one or more of the items 310, FIG. 31D.

Figure 32A:
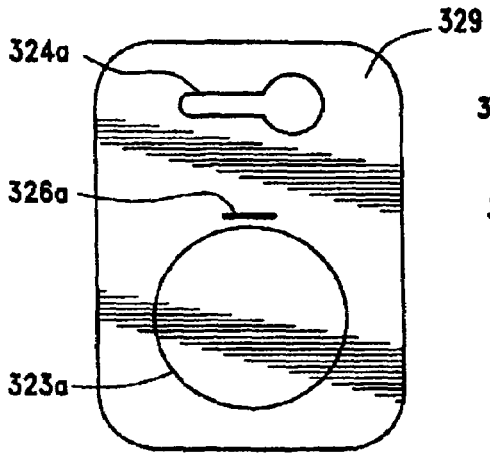
FIG. 32A is a top view of a box for making a target according to the present invention.
Figure 32B:
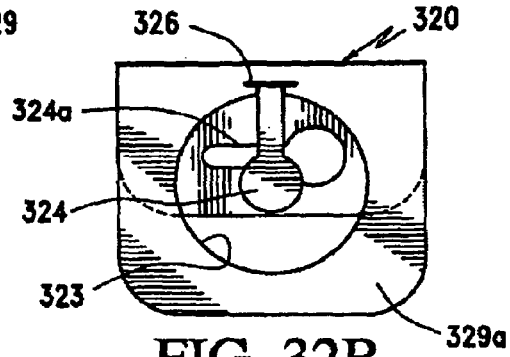
FIG. 32B is a perspective view of a target according to the present invention made from the box of FIG. 32A.
Figure 32C:
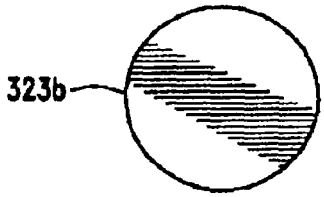
FIG. 32C is a top view of a throwing object cut from the box of FIG. 32A.

FIG. 32B shows a target 320 according to the present invention made from a box 329. An opening 323 is made by cutting or severing along line 323*a*, FIG. 32A, which also produces a throwing object 323*b* (FIG. 32C). A secondary target 324 is made by cutting or severing along line 324*a*, FIG. 32A. The secondary target 324 is hung from the remaining box part 329*a* by inserting an end of the secondary target through an opening 326 made by cutting through or severing a line 326*a*, FIG. 32A. Folding the part of the box 329 seen in FIG. 32A (which has been separated from the box as shown in FIG. 32B) makes it possible for the target 320 to stand upright with the secondary target 324 hanging in the opening 323. Any throwing object or disc disclosed herein may be used to hit the secondary target 324 and/or to pass through the opening 323. It is also within the scope of this invention to make the secondary target any shape disclosed herein; to use two, three or more secondary targets; and to use any box disclosed herein as the box 329.

Alternatively the secondary target 324 may be cut-out or separated from the box 329 so that it has a part still connected to the box and so that it hangs down in an opening made like that shown in FIG. 32B. A secondary target or targets of any desired shape may thus be made.

Figure 33A:
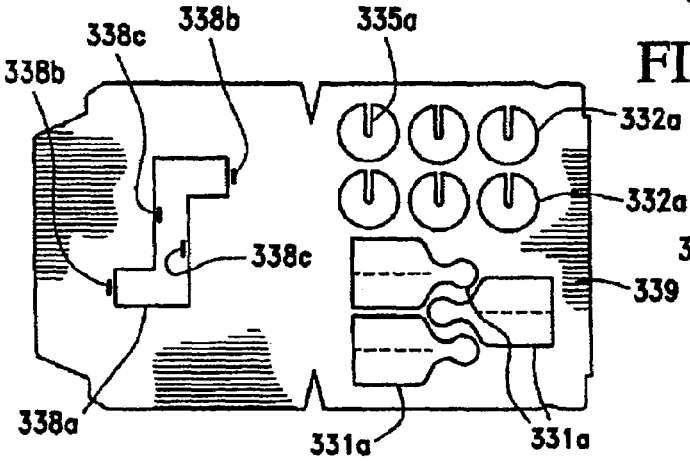
FIG. 33A is a top view of a box for making a target according to the present invention.
Figure 33D:
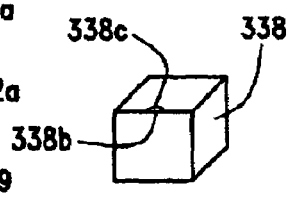
FIG. 33D is a perspective view of a throwing object made from part of the box of FIG. 33A.
Figure 33E:
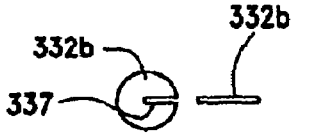
FIG. 33E is a side view showing two parts made from the box of FIG. 33A prior to meshing of the two parts.
Figure 33B:
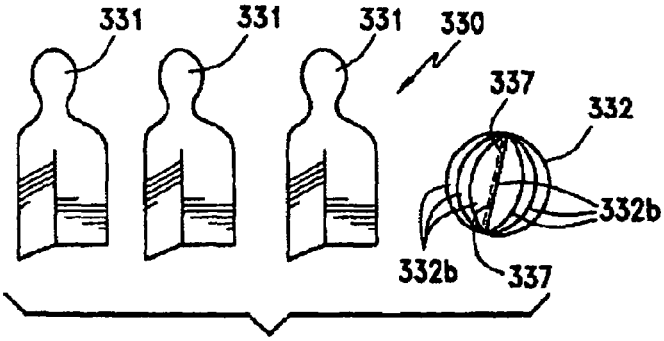
FIG. 33B shows a set of knock-down pins and a throwing object made from the box of FIG. 33A.

FIG. 33B shows a game set 330 with game pieces 331 and a throwing object 332 made from part of a box 339 (FIG. 33A). Knock-down game pieces 331 are made by cutting or severing box part 339 along lines 331*a* and the throwing object 332 is assembled from parts 332*b* made by cutting or severing along lines 332*a*, FIG. 33A.

Figure 33C:
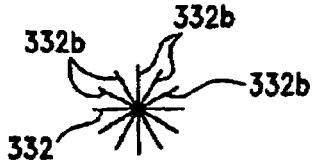
FIG. 33C is a top view of the throwing object shown in FIG. 33B.

Each throwing object part 332*b* has a slot 337 made by cutting along lines 335*a* (FIG. 33A). Thus when the parts 332*b* are divided in two sets of three each with their slots aligned, the two sets are combined by moving adjacent set parts into adjacent slots. Then the parts 332*b* are separated, as shown in FIGS. 33B and 33C, creating a throwing object 332 that will roll on a surface.

As shown in FIG. 33B, part of the lower portion of the game pieces 331 has been folded so that the game pieces 331 can stand upright until knocked over by a thrown or rolled throwing object 332. It is within the scope of this invention to use any throwing object disclosed herein to knock down the game pieces 331 and any number of such pieces (one, two, three–nine, or more) may be used.

FIG. 33D shows how two (or more) of the parts 332*b* are fitted together with their slots 337 aligned and then the two parts are pushed together with each slot receiving a portion of the opposing part. With slots of sufficient size stacks of multiple parts may thus be meshed together (e.g. as in FIG. 33C).

The box 339 of FIG. 33A optionally includes a line 338*a* which indicates a shape that may be separated from the box 339 to construct a throwing object 338 as shown assembled in FIG. 33D. Optional tabs 338*b* are insertable in corresponding openings 338*c*.

Figure 34A:
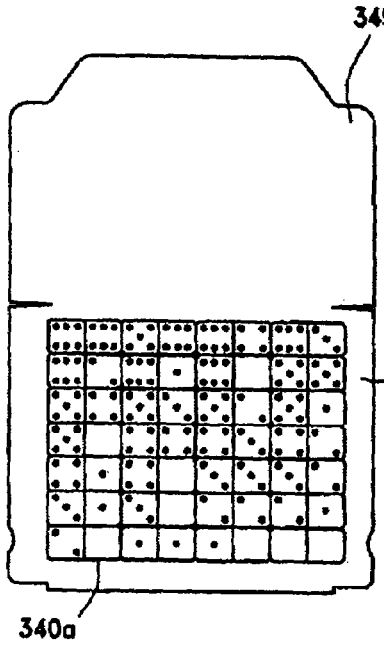
FIG. 34A is a top view of a box part according to the present invention with game pieces (dominoes) printed thereon.
Figure 34B:
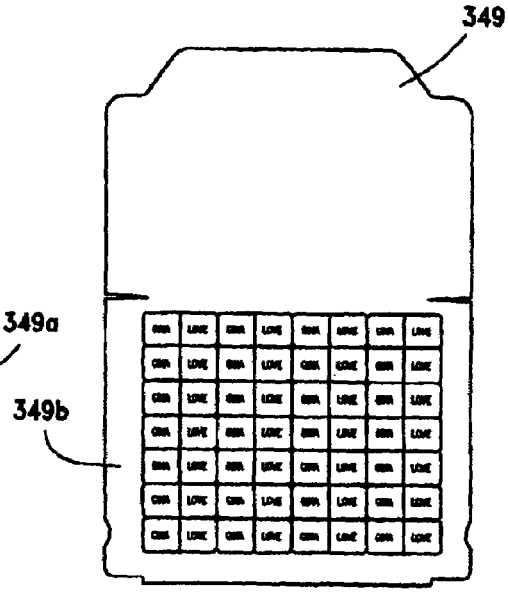
FIG. 34B is a top view of a reverse side of the box part shown in FIG. 34A.
Figure 34C:
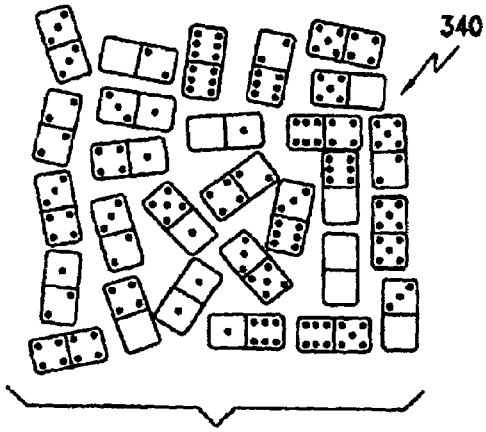
FIG. 34C shows dominoes made from the box part of FIG. 34A.
Figure 34D:
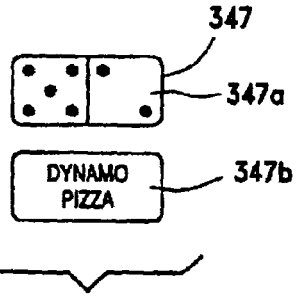
FIG. 34D shows both sides of a domino according to the present invention.

FIG. 34A shows a box part 349 with a first surface 349*a* printed with a set of dominoes 340*a*. By cutting along the outlines of the dominoes a set of dominoes 340 (FIG. 34C) is produced. As shown in FIG. 34B, a reverse surface 349*b* on the other side of the surface 349*a* of FIG. 34A is printed with a trademark, tradename or other identifier, in this case "GINA LOVE," which is in registration with the dominoes of the surface 349*a*. Thus when the dominoes are separated from the box, each domino will bear the mark, name, or identifier. An example of this is shown in FIG. 34C in which a domino 347 according to the present invention which has been separated from a box has a side 347*a* with typical domino dots and a reverse side 347*b* with the words "DYNAMO PIZZA." Any game piece, throwing object, or part cut from a box disclosed herein may have printing in registration on both sides (opposite box surfaces of the same part of a box) like the dominoes 340 or 347.

Instead of dominoes as printed on the box part of FIG. 34A, any game pieces may be printed thereon, e.g., but not limited to, checkers or chess pieces; and any game board (checkerboard, parchisi, etc.) may be printed thereon or on a part of a box spaced-apart from an area on which game pieces are printed. Alternatively, the alphabet, times tables, maps, artworks, puzzles, flashcards, word games, word game pieces or letters, crossword puzzles, TV schedules, coupons, movie tickets, tickets for sporting events, trivia tests, book summaries, and/or course outlines may be printed on part of a box.

Figure 35A:
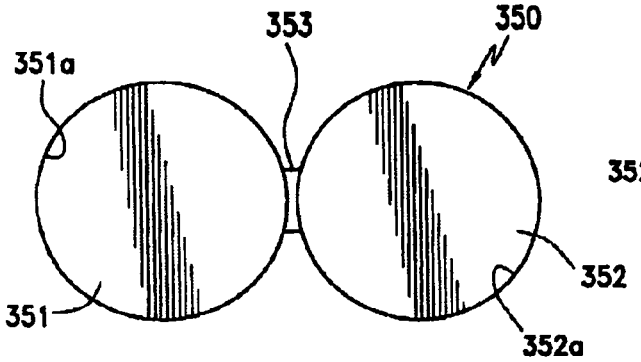
FIG. 35A is a top view of an opened box according to the present invention.
Figure 35B:
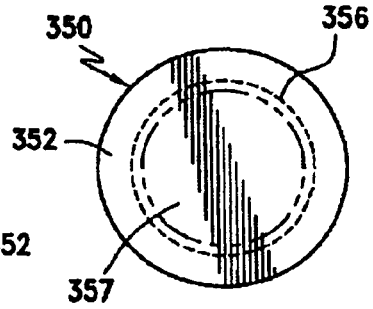
FIG. 35B is a top view of the box of FIG. 35A closed.

FIGS. 35A and 35B shows a box 350 according to the present invention which has a bottom 351 and a top 352 joined hingedly together by a tearable, cuttable, or severable part 353. Upon tearing, etc., the part 353, two throwable discs are created. Alternatively, the two parts may be connected or adhered together to form a single throwing disc. Optionally parts of one disc's edges or an entire disc's edge may be turned down to create any of the flyer discs disclosed herein and described above. As shown in FIG. 35B the box 350 may be closed to contain a food item 357 (e.g., but not limited to, a cake, pie, or pizza 355). Optionally the cake, etc. may rest on a separate round support 356 which itself may be used as a throwing disc or as part of any flyer disc disclosed herein. It is within the scope of this invention for the bottom 351 and/or top 352 to have a side 351*a*, 352*a*, respectively around its perimeter of sufficient height so that a cake, etc. is enclosable within the box 350. Such a side or sides may be provided for any box described or disclosed herein.

Figure 36A:
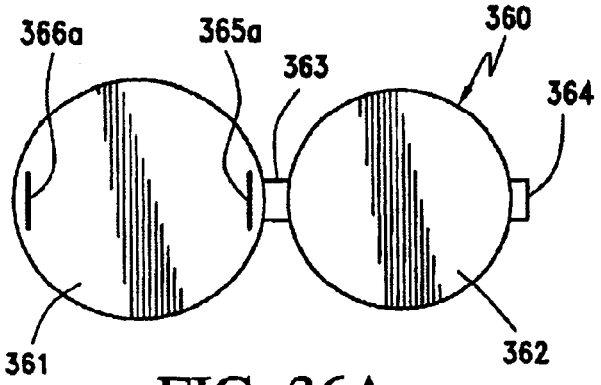
FIG. 36A is a top view of an open box according to the present invention.
Figure 36B:
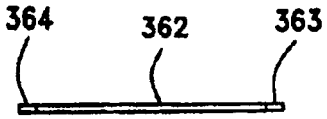
FIG. 36B is a side view of part of the box of FIG. 36A.
Figure 36C:
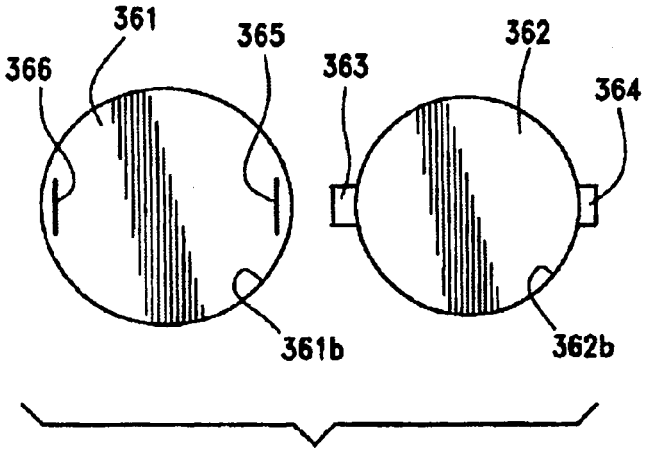
FIG. 36C is a top view of parts of the box of FIG. 36A.
Figure 36D:
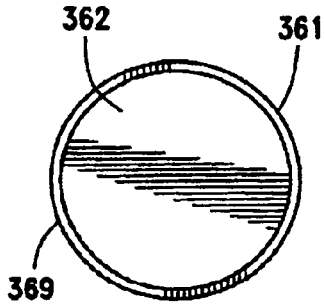
FIG. 36D is a top view of the box of FIG. 36A closed.

FIG. 36A shows a box 360 according to the present invention which has a bottom 361 and a top 362 releasably connected to the bottom 361 with a part 363 which may be torn, cut, or severed producing two generally circular box parts which may be used a throwing discs in any game or activity disclosed herein (as may the bottom and top of FIG. 35A). The top 362 has an optional tab 364. The part 363 and the tab 364 are sized and positioned so that they are receivable, respectively in openings 365, 366 made by cutting or severing along lines 365*a*, 366*a*, FIG. 36A. Parts 361, 362 are produced as shown in FIG. 36C. They may be combined to produce a multi-part throwing disc 369, FIG. 36D, by inserting part 363 of the top 362 into opening 365 of the bottom 361 and part 364 of the top 362 into opening 366 of the bottom 361. As with the box of FIG. 35A, the parts 361, 362 may have sidewalls 361*b*, 362*b* respectively, therearound of a desired height.

Figure 37A:
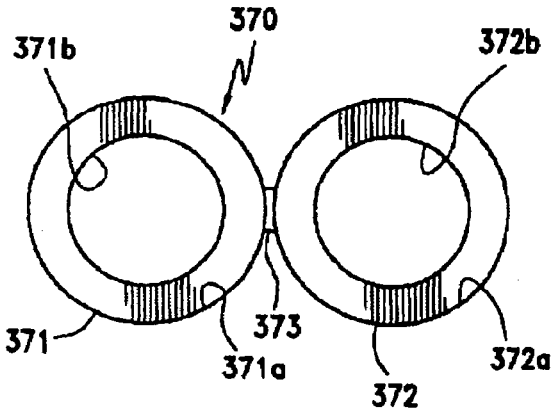
FIG. 37A is a top view of an open box according to the present invention.

FIG. 37A shows a box 370 according to the present invention with a bottom 371 and a top 372 each of which has a circular shape when viewed from above or below. The top 372 and bottom 371 are connected together along a box portion 373 and the top 372 can be folded at this portion 373 over and into contact with the bottom 371. The top 372 and/or the bottom 371 may have, respectively an upstanding perimeter sidewall 372*a*, 371*a* of any desired height (as may any box according to the present invention shown in top view herein). The top 372 may be connected to the bottom 371 when the top 372 is folded over on the bottom 371 in any manner disclosed herein, including, but not limited to, by fastener(s), glue, and/or interfitting part(s) or structure(s). It is within the scope of this invention for the top 372 and bottom 371 to be of any identical shape, e.g. but not limited to, triangular, square, rectangular, pentagonal, etc. Optionally an opening 372*b* may be made in the top 372 and/or any opening 371*b* may be made in the bottom 371 and such opening(s) may be of any desired size or shape and any piece thus separated therefrom may be used for any throwing object(s), disc(s), and/or knock down item(s) disclosed herein.

Figure 37B:
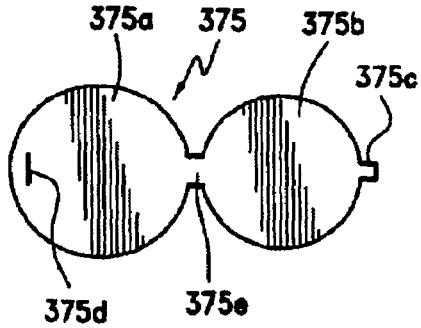
FIG. 37B is a top view of an open box according to the present invention.

FIG. 37B illustrates a box 375 according to the present invention with a bottom 375*a*, with an opening 375*d* and a top 375*b* with a tab 375*c* sized and configured so that upon folding of the top 375*b* on the bottom 375*a* the tab 375*c* is insertable into the opening 375*d* to hold the top 375*b* and the bottom 375*b* together. A hinge part 375*e* integral with the box 375 permits folding of the top 375*b* with respect to the bottom 375*a*. Such structure (tab, opening, and/or hinge part) to hold two parts together may be used for any box disclosed herein.

Figure 37C:
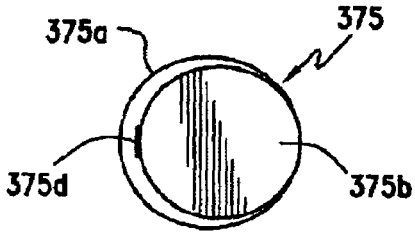
FIG. 37C is a top view showing the box of FIG. 37B closed.

FIG. 37C shows a closed version of the box 375 with the top 375*b* folded over on the bottom 375*a* and the tab 375*c* in the opening 375*d*. As with any such tab or part end disclosed herein, the tab 375*c* may be turned or twisted to prevent it from coming out of the opening 375*d*.

Figure 37D:
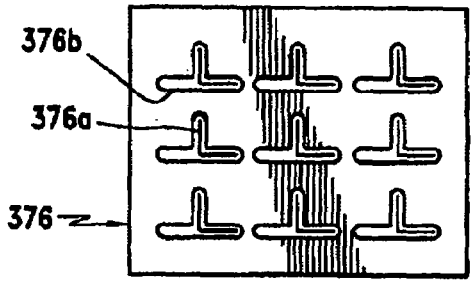
FIG. 37D is a side view of a target according to the present invention made from a box.

FIG. 37D shows a target 376 according to the present invention which has projecting parts 376*a* (like those of FIG. 23B) extending through slots 376*b* (like those of FIGS. 23A and 23B). The projecting parts 376*a* are coming out of the drawing sheet as viewed in FIG. 37D. Each part may be used as a target toward which a throwing object with an opening is thrown in an effort to have it land over and encompass the part 376*a*. In one aspect the target 376 may be used to play a "TIC-TAC-TOE" type of game with each player having multiple throwing objects to throw at the various parts 376*a* in an effort to have three thrown objects in a row on three aligned parts 376*a*.

Figure 38:
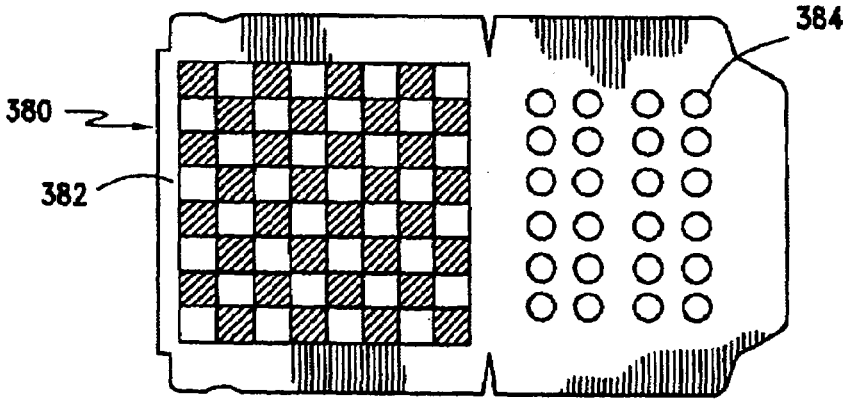
FIG. 38 is a top view of an open box according to the present invention.

FIG. 38 discloses a box 380 on which is printed or provided a checkerboard (or chessboard) 382 which may be used for board games that use such a checkerboard. The checkerboard 382 may remain on the box 380 or it may be separated from it. Game pieces 384 may be printed or otherwise provided on the box 380 and separated therefrom. The game pieces may be checkers (as shown) or chess pieces or any other game pieces used in a board game. Either the board 382 or the game pieces 384 may be deleted from the box 380.

The teachings of the present invention can be applied to various prior art boxes, including, but not limited to, the boxes referred to in the Description Of Related Art section above.

The present invention, therefore, provides in certain, but not necessarily all embodiments, a play activity set with target apparatus(es) and/or device(s) at which at least one object may be directed, at least one object for throwing at the target apparatus(es) and/or device(s), the target apparatus(es) and/or device(s) and the at least one object made by separating box material from at least one box. Such a set may also include one or some (in any possible combination) of the following: the target apparatus(es) and/or device(s) (henceforth referred to colleftively as "target") and the at least one object are separated from a single box; wherein the single box is a pizza box; wherein the target has at least one target opening in a box; wherein the target and the at least one object are made from a single box, and the at least one target opening is made in said single box; wherein the at least one object is a plurality of objects; wherein the target means has at least one portion of a box formed of the box and projecting therefrom; wherein the box has an opening therethrough, and the at least one portion of a box formed of the box and projecting therefrom extends through the opening; the box having two box parts, one part foldable over on the other part, the at least one target opening in one of the box parts, at least one stabilizer portion partially separated from one of the box parts opposite a box part with the at least one target opening, the box having a stabilizer opening corresponding to each of the at least one stabilizer portion, a part of the at least one stabilizer portion extending through the stabilizer opening; wherein the target has at least one target opening made by separating a target part of the box from the box, and the at least one object is made from the target part; wherein the at least one target opening is made by separating a target part of the box from the box, and the at least one object is made from the target part; wherein the at least one object is a plurality of objects; wherein the at least one object is a plurality of objects; wherein the at least one object has indicia thereon; wherein the indicia is scoring indicia; wherein the at least one object has two opposed surfaces each with indicia thereon; wherein the two opposed surfaces are a first surface and a second surface, and indicia on the first surface includes scoring indicia; wherein the at least one object is a plurality of objects, and each object has indicia thereon; wherein the indicia includes scoring indicia; wherein the target has at least one knock-down item made from a box; wherein the at least one knock-down item and the at least one object are separated from a single box; wherein the at least one knock-down item comprises a plurality of knock-down items; wherein the object is at least one piece of flat box material separated from a box; wherein the at least one piece of flat box material is a flying disc with a disc body having an outer perimeter and a plurality of portions of the disc body folded from the disc body around the outer perimeter; wherein the at least one piece of flat box material is a flying disc a disc body having an outer perimeter and a plurality of cuts spaced-apart around the outer perimeter, at least one portion of the disc body between at least one pair of the cuts, the at least one portion folded at an angle to the disc body; a plurality of secondary objects separated form the at least one object; the plurality of secondary objects comprising a plurality of throwing discs; and/or wherein the target, the at least one object, and the plurality of secondary objects are made from a single box.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A play activity set comprising
target means,
at least one object for throwing at the target means,
the target means and the at least one object made from box material from at least one box,
the at least one object is flat and comprises a flying disc, the flying disc comprising
a disc body having an outer perimeter,
a plurality of portions of the disc body folded from the disc body around the outer perimeter,
a plurality of cuts spaced-apart around the outer perimeter of the disc body, and
at least one portion of the disc body between at least one pair of the plurality of cuts, said at least one portion folded at an angle to the disc body.

2. The play activity set of claim 1 wherein the at least one box is a single box and the target means and the at least one object are from said single box.

3. The play activity set of claim 2 wherein
the single box is suitable for containing a pizza.

4. The play activity set of claim 2 wherein the target means includes at least one target opening, and
the at least one target opening is in said single box.

5. The play activity set of claim 1 wherein
the target means including at least one target opening in said at least one box.

6. The play activity set of claim 5 further comprising
the at least one box having two box parts, one part foldable over on the other part, the at least one target opening in one of the box parts,
at least one stabilizer portion partially separated from one of the box parts opposite a box part with the at least one target opening,
the at least one box having a stabilizer opening corresponding to each of the at least one stabilizer portion,
a part of the at least one stabilizer portion extending through the stabilizer opening.

7. The play activity set of claim 1 wherein
the at least one object is a plurality of objects.

8. The play activity set of claim 1 wherein the at least one box has at least one stabilizing portion formed of the at least one box and projecting therefrom.

9. The play activity set of claim 8 wherein
the at least one box has an opening therethrough for receiving a stabilizing portion of the at least one box, and
the at least one stabilizing portion of the at least one box projects through the opening.

10. The play activity set of claim 1 wherein
at least one target part is removed from the at least one box and said removal forming a target opening through the at least one box, and
the at least one object comprises at least a portion of the target part.

11. The play activity set of claim 1 wherein
the at least one object has indicia thereon.

12. The play activity set of claim 1 wherein
the indicia is scoring indicia.

13. The play activity set of claim 1 wherein
the at least one object has two opposed surfaces each with indicia thereon.

14. The play activity set of claim 13 wherein
the two opposed surfaces include two surfaces at least one of whose indicia is scoring indicia.

15. The play activity set of claim 1 wherein
the at least one object is a plurality of objects, and
each object has indicia thereon.

16. The play activity set of claim 15 wherein
the indicia includes scoring indicia.

17. The play activity set of claim 1 wherein
the target means comprises at least one item separated from a box, said at least one item able to be knocked down by a thrown object.

18. The play activity set of claim 1 wherein the flying disc further comprises
a plurality of cuts spaced-apart around the outer perimeter of the disc body,
at least one portion of the disc body between at least one pair of the plurality of cuts, said at least one portion folded at an angle to the disc body.

19. The play activity set of claim 1 further comprising
a plurality of secondary objects removed from the at least one object.

20. The play activity set of claim 19 further comprising
the plurality of secondary objects comprising a plurality of throwing discs.

21. A play activity set comprising
target means at which at least one object may be directed,
at least one object for throwing at the target means,
the target means and the at least one object made from box material from at least one box, the at least one object is flat and comprises a flying disc, the flying disc comprising a disc body having an outer perimeter and a plurality of cuts spaced-apart around the outer perimeter, at least one portion of the disc body between at least one pair of the cuts, the at least one portion folded at an angle to the disc body, a plurality of cuts spaced-apart around the outer perimeter of the disc body, and at least one portion of the disc body between at least one pair of the plurality of cuts, said at least one portion folded at an angle to the disc body.

* * * * *